US010882707B2

(12) United States Patent
Uchino

(10) Patent No.: US 10,882,707 B2
(45) Date of Patent: Jan. 5, 2021

(54) FEED APPARATUS AND IMAGE RECORDING APPARATUS

(71) Applicant: BROTHER KOGYO KABUSHIKI KAISHA, Nagoya (JP)

(72) Inventor: Yuta Uchino, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 15/492,202

(22) Filed: Apr. 20, 2017

(65) Prior Publication Data

US 2017/0217700 A1 Aug. 3, 2017

Related U.S. Application Data

(63) Continuation of application No. 14/501,585, filed on Sep. 30, 2014, now Pat. No. 9,637,334.

(30) Foreign Application Priority Data

Dec. 11, 2013 (JP) ..... 2013-255911

(51) Int. Cl.
*B65H 3/06* (2006.01)
*B65H 3/34* (2006.01)
(Continued)

(52) U.S. Cl.
CPC ..... *B65H 3/34* (2013.01); *B41J 11/04* (2013.01); *B65H 1/02* (2013.01); *B65H 3/0684* (2013.01);
(Continued)

(58) Field of Classification Search
CPC .. B65H 2301/42328; B65H 2301/4234; B65H 3/5246; B65H 3/5253; B65H 3/54;
(Continued)

(56) References Cited

U.S. PATENT DOCUMENTS 3,640,524 A 2/1972 Fredrickson
5,209,465 A 5/1993 Sayama et al.
(Continued)

FOREIGN PATENT DOCUMENTS

CN 1254865 A 5/2000
CN 1364726 A 8/2002
(Continued)

OTHER PUBLICATIONS

Office Action issued in related U.S. Appl. No. 14/663,197, dated Oct. 2, 2015.
(Continued)

*Primary Examiner* — Thomas A Morrison
(74) *Attorney, Agent, or Firm* — Merchant & Gould P.C.

(57) ABSTRACT

There is provided a feed apparatus including a support unit having a support surface, a feed roller, a first arm to support the feed roller, a recess portion on the support surface, a second arm swingable, with a side of the one end as a swing shaft, between a first position at which the other end of the second arm is in the recess portion and a second position at which the other end is outside the recess portion; and a biasing member. In a case that the second arm is the first position, a guide surface of the second arm is positioned on an upstream side of the feed roller in the feed direction and in a case that the second arm is the second position, the other end of the second arm is positioned on a downstream side of the feed roller in the feed direction.

18 Claims, 13 Drawing Sheets

(51) Int. Cl.

| | |
|---|---|
| ***B65H 1/02*** | (2006.01) |
| ***B65H 3/54*** | (2006.01) |
| ***B65H 3/66*** | (2006.01) |
| ***B41J 11/04*** | (2006.01) |

(52) U.S. Cl.
CPC ..... *B65H 3/54* (2013.01); *B65H 3/66* (2013.01); *B65H 2404/63* (2013.01); *B65H 2404/693* (2013.01); *B65H 2405/324* (2013.01); *B65H 2407/21* (2013.01); *B65H 2801/06* (2013.01)

(58) Field of Classification Search
CPC ... B65H 3/66; B65H 3/46; B65H 3/50; B65H 3/0661; B65H 3/0684; B65H 3/0669
See application file for complete search history.

(56) References Cited

U.S. PATENT DOCUMENTS

| | | | | |
|---|---|---|---|---|
| 5,915,684 | A * | 6/1999 | Nakagawa | B65H 3/0661 271/110 |
| 6,260,840 | B1 | 7/2001 | Suga et al. | |
| 6,354,584 | B1 | 3/2002 | Suga et al. | |
| 6,375,183 | B1 | 4/2002 | Inoue et al. | |
| 6,659,449 | B2 * | 12/2003 | Kim | B65H 1/266 271/117 |
| 6,918,583 | B2 | 7/2005 | Asada et al. | |
| 7,607,655 | B2 | 10/2009 | Oomori et al. | |
| 7,857,303 | B2 | 12/2010 | Oomori et al. | |
| 7,950,650 | B2 | 5/2011 | Koyanagi | |
| 8,061,705 | B1 * | 11/2011 | Su | B65H 3/0684 271/109 |
| 8,254,826 | B2 | 8/2012 | Uchino et al. | |
| 8,366,096 | B2 | 2/2013 | Mizude et al. | |
| 8,556,258 | B2 | 10/2013 | Mizubata et al. | |
| 9,346,637 | B2 | 5/2016 | Uchino et al. | |
| 2001/0015519 | A1 | 8/2001 | Kuo et al. | |
| 2002/0084574 | A1 | 7/2002 | Kim | |
| 2003/0021608 | A1 | 1/2003 | Morita et al. | |
| 2004/0026849 | A1 | 2/2004 | Kang et al. | |
| 2004/0256787 | A1 * | 12/2004 | Wada | B65H 3/0669 271/109 |
| 2007/0001375 | A1 * | 1/2007 | Zhu | B65H 3/0661 271/117 |
| 2008/0203650 | A1 | 8/2008 | Ito et al. | |
| 2008/0265487 | A1 * | 10/2008 | Butikofer | B65H 3/0684 271/110 |
| 2009/0026685 | A1 | 1/2009 | Uchino et al. | |
| 2010/0001453 | A1 | 1/2010 | Mizude et al. | |
| 2011/0267412 | A1 | 11/2011 | Sakano | |
| 2011/0309569 | A1 | 12/2011 | Huang et al. | |
| 2012/0080836 | A1 | 4/2012 | Morisaki | |
| 2012/0235344 | A1 | 9/2012 | Liu | |
| 2013/0140765 | A1 | 6/2013 | Mizubata et al. | |
| 2015/0158684 | A1 | 6/2015 | Uchino | |
| 2015/0183598 | A1 | 7/2015 | Suganuma | |
| 2015/0274454 | A1 | 10/2015 | Uchino | |
| 2016/0251176 | A1 | 9/2016 | Uchino et al. | |

FOREIGN PATENT DOCUMENTS

| | | | |
|---|---|---|---|
| CN | 1473712 | A | 2/2004 |
| CN | 101254865 | A | 9/2008 |
| CN | 102233747 | A | 11/2011 |
| CN | 102442561 | A | 5/2012 |
| JP | 61-27841 | A | 2/1986 |
| JP | 04-323144 | A | 11/1992 |
| JP | 4-358668 | A | 12/1992 |
| JP | 7-221934 | A | 8/1995 |
| JP | 09-301575 | A | 11/1997 |
| JP | 2000-53266 | A | 2/2000 |
| JP | 2001-80759 | A | 3/2001 |
| JP | 2001-106346 | A | 4/2001 |
| JP | 2002-173233 | A | 6/2002 |
| JP | 2002-226086 | A | 8/2002 |
| JP | 2003-104587 | A | 4/2003 |
| JP | 2005-314042 | A | 11/2005 |
| JP | 2005-314043 | A | 11/2005 |
| JP | 2007-264641 | A | 10/2007 |
| JP | 2011-236054 | A | 11/2011 |
| JP | 2012-218938 | A | 11/2012 |

OTHER PUBLICATIONS

U.S. Office Action (Notice of Allowance) issued in related U.S. Appl. No. 14/663,197, dated Jan. 11, 2016.
Chinese Office Action issued in CN 201410497812.1, dated Apr. 25, 2016.
U.S. Office Action (Notice of Allowance) issued in related U.S. Appl. No. 15/149,350, dated Oct. 17, 2016, 11 pgs.
U.S. Office Action (Notice of Allowance) issued in related U.S. Appl. No. 15/149,350, dated Jan. 10, 2017, 5 pgs.
Chinese Office Action issued in CN 201510101353.5, dated Sep. 27, 2016, 9 pgs.
U.S. Office Action issued in related U.S. Appl. No. 15/149,350, dated Jul. 5, 2016, 15 pgs.
Related U.S. Appl. No. 14/663,197, filed Mar. 19, 2015.
Notice of Reasons for Rejection issued in related Japanese Application No. 2014-117537, dated Jan. 23, 2018.
Office Action from corresponding Japanse Patent Application No. 2016-243050, dated Oct. 17, 2017.
Office Action issued in related Chinese Patent Application No. 201710532522.X, dated Aug. 15, 2018.
Office Action (Notice of Reasons for Rejection) issued in related Japanese Application No. 2014-112371, dated Dec. 5, 2017.
Office Action (Notice of Reasons for Rejection) issued in related Japanese Patent Application No. 2014-112371, dated Jun. 26, 2018.
Office Action (Notice of Reasons for Rejection) issued in related Japanese Application No. 2014-117542, dated Apr. 10, 2018.
Office Action (Decision of Refusal) issued in related Japanese Patent Application No. 2016-243050, dated May 8, 2018.
Second Office Action issued in related Chinese Patent Application No. 201710532522.X, dated Mar. 7, 2019.
Final Notification of Reasons for Refusal issued in corresponding Japanese Patent Application No. 2018-148230, dated Mar. 24, 2020.

* cited by examiner

FEED APPARATUS AND IMAGE RECORDING APPARATUS

CROSS REFERENCE TO RELATED APPLICATION

The present application is a continuation of U.S. patent application Ser. No. 14/501,585, filed Sep. 30, 2014, and further claims priority from Japanese Patent Application No. 2013-255911, filed on Dec. 11, 2013, the disclosure of both of which is incorporated herein by reference in their entirety.

BACKGROUND

Field of the Invention

The present teaching relates to a feed apparatus feeding a sheet supported by a support unit and an image recording apparatus including the feed apparatus.

Description of the Related Art

There is conventionally known a feed apparatus configured such that a support unit in a state of being inclined supports a plurality of sheets stacked thereon and each of the sheets is fed obliquely downward along the inclination of the support unit. In this feed apparatus, the sheets supported by the support unit are biased by the own weight of a feed roller.

However, in such feed apparatus, the sheets supported by the support unit in the state of being inclined are more likely to move along the inclination of the support unit by its own weight or the following cause. That is, in a case that a sheet arranged on the uppermost side is fed by the rotation of the feed roller, a sheet abutting against the uppermost sheet is dragged (moves together with the uppermost sheet) due to the frictional force between the uppermost sheet and the sheet abutting against the uppermost sheet. As a result, there is fear that the overlapped feed of sheets are more likely to occur. Further, the overlapped feed of sheets could be caused also by the following phenomenon. That is, in the feed apparatus, there is some distance between a separation claw which is a separation member and the feed roller. Thus, although the sheets are biased against the support unit at a position at which the sheets abut against the feed roller, no sheet is biased against the support unit by the feed roller in an area between the separation claw and the feed roller. Therefore, a gap may be sometimes formed between the sheets during the consecutive feed of sheets. In such a case, the abutting angles between the sheets and the separation claw vary, which causes the variation of the conveyance force required to let the sheet ride over the separation claw, and thus the overlapped feed of sheets could occur.

SUMMARY

The present teaching has been made to solve the foregoing problems, an object of which is to provide a means capable of reducing the possibility of occurrence of the overlapped feed (or multi feed) of sheets.

A feed apparatus according to the present teaching includes: a support unit including a support surface which is configured to support a sheet; a feed roller configured to feed the sheet supported by the support surface in a feed direction; a first arm configured to be swingable about a swing shaft and rotatably support the feed roller about a shaft different from the swing shaft; a recess portion provided on the support surface; a second arm having one end configured to be positioned on an upstream side of the other end in the feed direction; having a distance between the one end and the support surface which is greater than a distance between the other end and the support surface; and configured to be swingable with a side of the one end as a swing shaft, between a first position at which the other end is in the recess portion and a second position at which the other end is outside the recess portion; and a biasing member configured to bias the second arm toward the first position. In a case that the second arm is positioned at the first position, a guide surface of the second arm is positioned on an upstream side of the feed roller in the feed direction, the guide surface being a surface which is not in the recess portion, is configured to face the support surface, and is configured to extend from a position at which the second arm intersects with the support surface toward an upstream side in the feed direction. In a case that the second arm is positioned at the second position, the other end of the second arm is positioned on a downstream side of the feed roller in the feed direction.

According to this structure, in a state that no sheet is supported by the support unit, the second arm is positioned at the first position by being biased by the biasing member. In this situation, when one sheet or a plurality of sheets is/are allowed to enter the feed apparatus from the upstream side in the feed direction so that the sheet is supported by the support unit, the sheet abuts against the guide surface of the second arm first. In other words, the sheet does not abut against the feed roller first. Here, many of the feed rollers have a roller surface made of rubber, and thus the sheet coming into contact with the roller surface is more likely to be bent. In this structure, however, since the sheet does not abut against the feeing roller first, it is possible to reduce the possibility that the sheet entering the feed apparatus is bent.

Subsequently, the sheet entering the feed apparatus is guided to the downstream side in the feed direction along the guide surface of the second arm. In this situation, the second arm is pushed by the sheet, which causes the second arm to swing from the first position to the second position against the biasing force of the biasing member. Accordingly, the sheet can be guided between the feed roller and the support surface of the support unit.

Further, in a case that the second arm is positioned at the second position, the other end of the second arm is positioned on the downstream side of the feed roller in the feed direction. Thus, the sheet, which has passed between the feed roller and the support surface of the support unit by being guided by the second arm, is in a state of being held by the other end of the second arm (in a state of being biased against the support surface). That is, according to this structure, it is possible to hold the sheet on the downstream side of the feed roller in the feed direction (bias the sheet against the support surface). Accordingly, it is possible to reduce the possibility of-occurrence of the overlapped feed (or multi feed) of sheets as compared with a state in which the sheet is held only by the feed roller (a state in which the sheet is biased against the support surface only by the feed roller).

Another feed apparatus according to the present teaching includes: a support unit including a support surface which is configured to support a sheet; a feed roller configured to feed the sheet supported by the support surface in a feed direction; a first arm configured to be swingable about a swing shaft and rotatably support the feed roller about a shaft different from the swing shaft, the first arm moving the feed roller between a separated position at which the feed roller is separated from the sheet supported by the support surface and an a abutment position at which the feed roller abuts against the sheet supported by the support surface; a recess portion provided on the support surface; a second arm having one end configured to be positioned on an upstream side of the other end in the feed direction, having a distance between the one end and the support surface which is greater than a distance between the other end and the support surface, and configured to be swingable with a side of the one end as a swing shaft, between a first position at which the other end is in the recess portion and a second position at which the other end is outside the recess portion; and a biasing member configured to bias the second arm toward the first position. The second arm includes a guide surface which is directed to an upstream side in the feed direction and is defined between a lower side, which is positioned at the same position as the support surface in a direction orthogonal to the support surface, and an upper side which is positioned at the same position as a rotation center of the feed roller positioned at the separated position in the direction orthogonal to the support surface. In a case that the second arm is positioned at the first position, the upper side of the guide surface is positioned on an upstream side of an upstream-side end of the feed roller in the feed direction and the guide surface is positioned so as not to overlap with the feed roller as viewed from a direction orthogonal to the feed direction and extending along the support surface. In a case that the second arm is positioned at the second position, the other end of the second arm is positioned on a downstream side in the feed direction of a rotation center of the feed roller positioned at the abutment position.

According to the present teaching, it is possible to hold the sheet supported by the support unit (bias the sheet supported by the support unit against the support surface) on the downstream side of the feed roller in the feed direction. Thus, the possibility of occurrence of the overlapped feed (or multi feed) of sheets can be reduced.

DESCRIPTION OF THE EMBODIMENTS

Figure 1:
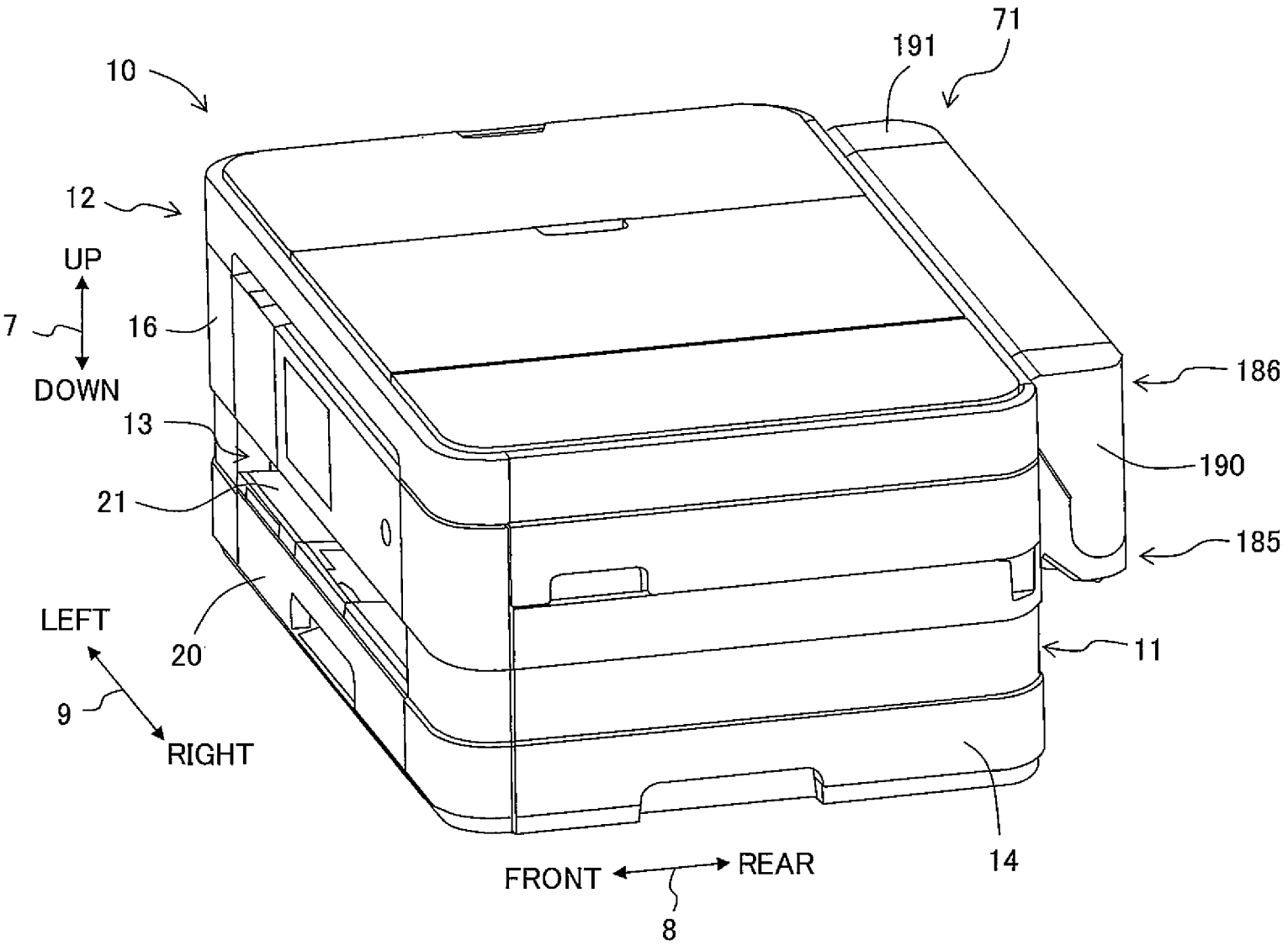
FIG. 1 is a perspective external view of a multifunction peripheral 10 in which a movable unit 186 is in an upstanding state.

An explanation will be made about a multifunction peripheral 10 according to an embodiment of the present teaching. It is needless to say that the embodiment to be explained below is merely an example of the present teaching, and it is possible to appropriately change the embodiment of the present teaching without departing from the gist and scope of the present teaching. Further, in the following explanation, an up-down direction 7 of the multifunction peripheral 10 is defined on the basis of such a state that the multifunction peripheral 10 is placed to be usable (a state depicted in FIG. 1); a front-rear direction 8 of the multifunction peripheral 10 is defined as an opening 13 is provided on the near side (the front side); and a left-right direction 9 of the multifunction peripheral 10 is defined as the multifunction peripheral 10 is viewed from the near side (the front side).

<Entire Structure of Multifunction Peripheral 10>

Figure 10:
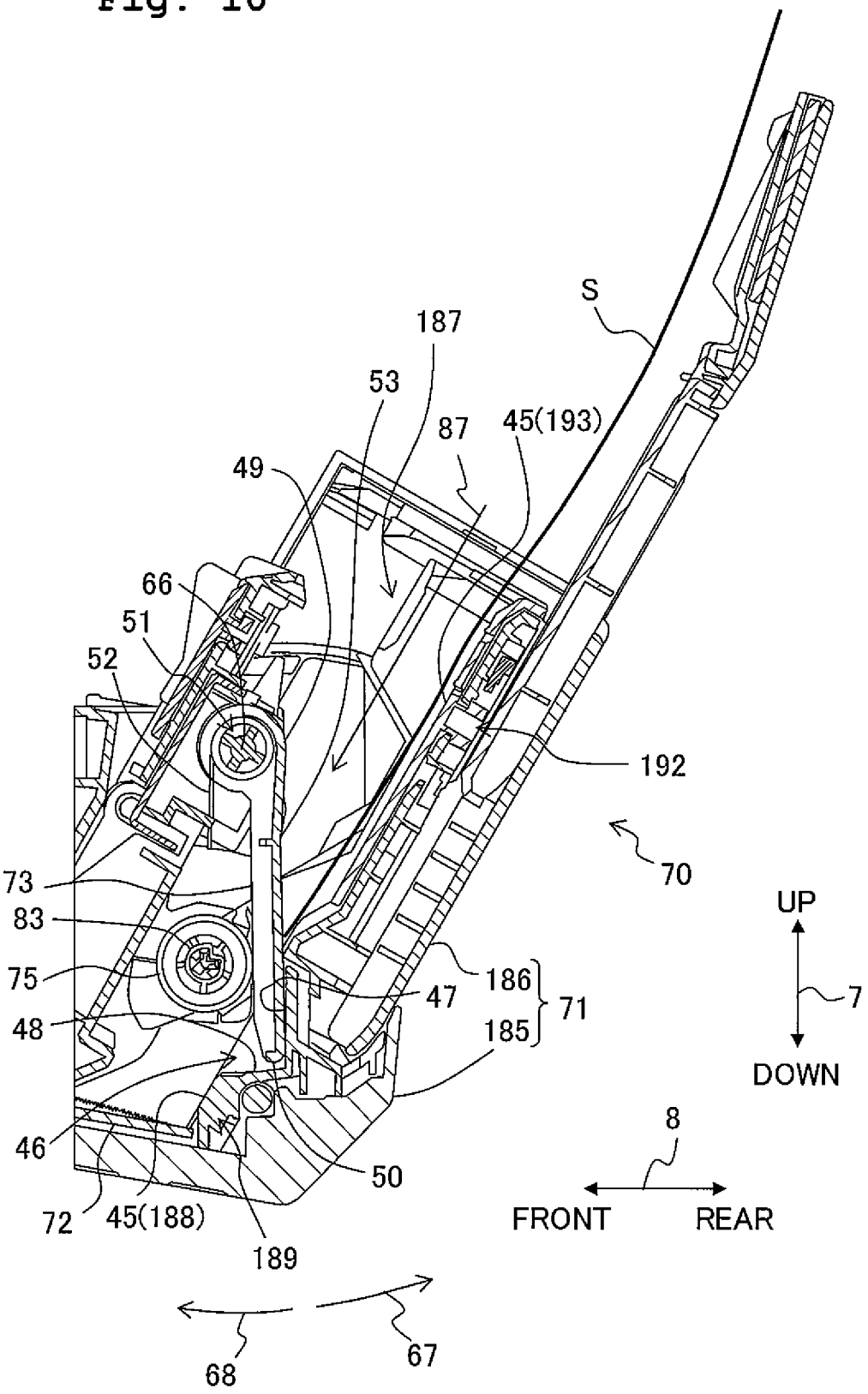
FIG. 10 is an enlarged view of the part enclosed in the rectangular frame depicted by dotted lines in FIG. 5 showing a state that the forward end of a recording sheet in an insertion direction abuts against a surface 53 of the holding arm 73.

As depicted in FIG. 1, the multifunction peripheral 10 is formed to have an approximately cuboid form, and the multifunction peripheral 10 includes a printer unit 11 of an ink-jet recording system to record an image on a sheet such as a recording sheet S (FIG. 10). The multifunction peripheral 10 includes various functions such as a facsimile function and a print function.

The printer unit 11 has a casing or housing body 14 with the opening 13 formed in its front surface. Further, a feed tray 20 and a discharge tray 21 are insertable to and removable from the casing 14 via the opening 13 in the front-rear direction 8. The feed tray 20 can load or accommodate recording sheets S in various sizes. The bottom surface of the casing 14 abuts against a placement surface on which the multifunction peripheral 10 is placed.

Figure 2:
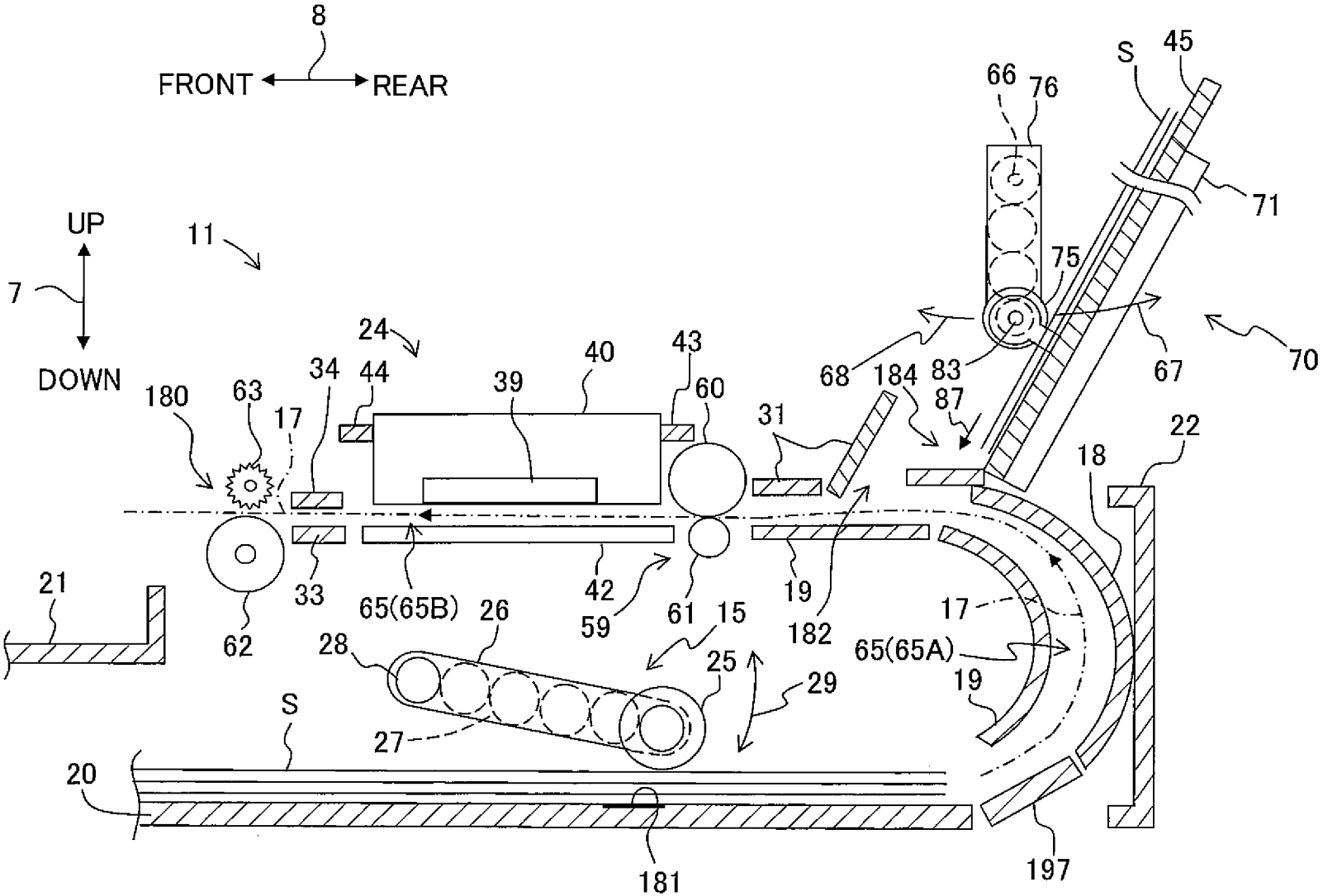
FIG. 2 is a schematic vertical cross-sectional view of an internal structure of a printer unit 11.

As depicted in FIG. 2, the printer unit 11 includes a feed unit 15 which feeds the recording sheet S from the feed tray 20, a recording unit 24 which records an image on the recording sheet S, a first conveyance roller pair 59, a second conveyance roller pair 180, and the like.

As depicted in FIG. 1, a scanner unit 12 is provided above the printer unit 11. The sizes of a casing or housing body 16 of the scanner unit 12 in the front-rear direction 8 and left-right direction 9 are the same as those of the casing 14 of the printer unit 11 in the front-rear direction 8 and left-right direction 9. Therefore, the casing 14 of the printer unit 11 and the casing 16 of the scanner unit 12 integrally form an outer shape of the multifunction peripheral 10 having the approximately cuboid form. The scanner unit 12 is a flatbed scanner. Since the structure of the flatbed scanner is publicly known, any detailed explanation of which will be omitted herein. The scanner unit 12 may include an automatic document feeder (ADF) for picking up a plurality of sheets of manuscript or document one by one and conveying each of the sheets.

<Printer Unit 11>

The structure of the printer unit 11 will be explained in detail below. The printer unit 11 is an exemplary image recording apparatus of the present teaching.

<Feed Tray 20>

As for the feed tray 20 depicted in FIGS. 1 and 2, the sizes in the front-rear direction 8 and the left-right direction 9 are bigger than the size in the up-down direction 7, and the feed tray 20 has a box-shaped form in which the upper surface is open. The discharge tray 21 is provided on the upper surface of the feed tray 20 at the front side. The feed tray 20 can accommodate the recording sheets S having various sizes such as the A4 size based on the Japanese Industrial Standards and the L size used for the photograph recording, by supporting the recording sheets S with a support surface. The feed tray 20 is detachably installed in the internal space communicating with the opening 13 of the casing 14. The feed tray 20 is movable back and forth in the front-rear direction 8 with respect to the casing 14 via the opening 13.

<Feed Unit 15>

As depicted in FIG. 2, the feed unit 15 includes a feed roller 25, a feed arm 26, a driving transmission mechanism 27 and a separation pad 181. The feed unit 15 is provided above the feed tray 20 and below the recording unit 24. The feed roller 25 is rotatably supported by the forward end of the feed arm 26. The feed arm 26 swings in the directions of the arrow 29 with a rotational shaft 28 provided at the proximal end as the center of swing. Accordingly, the feed roller 25 can abut against the support surface of the feed tray 20 and the feed roller 25 can be separated therefrom. Therefore, when the feed tray 20 loading the recording sheets S is installed in the casing 14, the feed roller 25 can abut against the recording sheets S placed on the feed tray 20. The separation pad 181 is provided at the position at which the feed roller 25 abuts against the support surface of the feed tray 20 when the feed tray 20, which accommodates no recording sheet S, is installed in the casing 14. The separation pad 181 is made of a material having a frictional coefficient with respect to the recording sheet S which is larger than a frictional coefficient with respect to the recording sheet S of the support surface of the feed tray 20.

The driving force of a motor (not depicted) is transmitted to the feed roller 25 by the aid of the driving transmission mechanism 27. The driving transmission mechanism 27 transmits the rotation transmitted to the rotational shaft 28 to the shaft of the feed roller 25 by an endless belt, a gear train etc. The feed roller 25 is rotated in such a state that the feed roller 25 is allowed to abut against the recording sheet S disposed on the uppermost side of the recording sheets S supported by the support surface of the feed tray 20, and thus the uppermost recording sheet S is fed to a conveyance path 65. In a case that the recording sheet S is fed to the conveyance path 65, the forward end of the recording sheet S abuts against a separation member 197 provided on the back side of the feed tray 20 in the front-rear direction 8. As a result, only the recording sheet S disposed on the uppermost side is separated from the recording sheets S disposed on a lower side and then conveyed. On the other hand, the recording sheets S disposed on the lower side of the uppermost recording sheet S are retained in the feed tray 20 without being dragged by the recording sheet S disposed on the uppermost side.

<Conveyance Path 65>

As depicted in FIG. 2, the conveyance path 65, which is provided in the internal space of the casing 14, extends while being curved to make U-turn upward from the back side of the feed tray 20. Further, the conveyance path 65 is bent toward the front side from the back side of the printer unit 11, and then extends substantially straight to the front side of the printer unit 11 to arrive at the discharge tray 21. The conveyance path 65 is roughly classified into a curved passage 65A which makes U-turn and a straight passage 65B which is straight.

The curved passage 65A is defined by an outer guide member 18, an inner guide member 19 and a guide member 31. The outer guide member 18 and the inner guide member 19, the inner guide member 19 and the guide member 31, and the guide member 31 and the outer guide member 18 are respectively opposed to each other while being separated by the space through which the recording sheet S can pass. The straight passage 65B is defined by the recording unit 24, a platen 42, a guide member 34 and a guide member 33. The recording unit 24 and the platen 42 are opposed to each other while being separated by the space through which the recording sheet S can pass, and the guide member 34 and the guide member 33 are opposed to each other while being separated by the space through which the recording sheet S can pass.

The recording sheet S, which is fed to the conveyance path 65 by the feed roller 25 of the feed tray 20, is conveyed from a lower side to an upper side of the curved passage 65A. In this situation, a conveyance direction of the recording sheet S is inverted from a backward direction to a forward direction. Then, the recording sheet S is conveyed from the rear side to the front side in the front-rear direction 8 through the straight passage 65B without inverting the conveyance direction.

The outer guide member 18 constitutes an outer guide surface of the curved passage 65A when the recording sheet S is conveyed via the curved passage 65A. The inner guide member 19 constitutes an inner guide surface of the curved passage 65A when the recording sheet S is conveyed via the curved passage 65A. Each of the guide surfaces may be constructed by one surface, or each of the guide surfaces may be constructed as an enveloping surface of forward ends of a plurality of ribs.

The guide member 31 is arranged above the inner guide member 19 on the immediately upstream side (the back side) of the first conveyance roller pair 59. The outer guide member 18 and the guide member 31 also define a bypass route 182 described later on.

<Back Surface Cover 22>

As depicted in FIG. 2, a back surface cover 22 constitutes a part of the back surface of the casing 14 while supporting the outer guide member 18. The back surface cover 22 is swingably supported with respect to the casing 14 on its lower side at both left and right ends. The back surface cover 22 is allowed to swing about the swing shaft provided on its lower side along the left-right direction 9 so that the upper side thereof is inclined backward, and thus a part of the conveyance path 65 and a part of the bypass route 182 described later on are open (exposed) to the outside of the casing 14.

The outer guide member 18 is also swingably supported with respect to the casing 14 on its lower side at both left and right ends in the same manner as the back surface cover 22. In a state that the back surface cover 22 is swung so that the upper side thereof is inclined backward, the outer guide member 18 is allowed to swing about the swing shaft provided on its lower side along the left-right direction 9 so that the upper side thereof is inclined backward. By allowing the outer guide member 18 to swing so that the upper side thereof is inclined backward, at least a part of the curved passage 65A is open (exposed). As depicted in FIG. 2, in a case that the back surface cover 22 is closed to be an upstanding state, the outer guide member 18 is supposed by the back surface cover 22 from the rear side to be maintained in an upstanding state, so that the outer guide member 18 is opposed to the inner guide member 19 to define the curved passage 65A.

<First Conveyance Roller Pair 59 and Second Conveyance Roller Pair 180>

As depicted in FIG. 2, in the conveyance path 65, the first conveyance roller pair 59 is provided on the upstream side of the recording unit 24 in the conveyance direction 17 (forward direction in the front-rear direction 8). The first conveyance roller pair 59 has a first conveyance roller 60 and a pinch roller 61. In the conveyance path 65, the second conveyance roller pair 180 is provided on the downstream side of the recording unit 24 in the conveyance direction 17. The second conveyance roller pair 180 has a second conveyance roller 62 and a spur roller 63. The rotation of a motor (not depicted) is transmitted to the first and second conveyance rollers 60, 62, and thus the first conveyance roller 60 and the second conveyance roller 62 are allowed to rotate. The first conveyance roller pair 59 and the second conveyance roller pair 180 convey the recording sheet S by rotating the first conveyance roller 60 and the second conveyance roller 62 in a state that the recording sheet S is interposed between the respective rollers constructing the first conveyance roller pair 59 and the second conveyance roller pair 180.

<Recording Unit 24>

As depicted in FIG. 2, the recording unit 24 is provided between the first conveyance roller pair 59 and the second conveyance roller pair 180. The recording unit 24 includes a carriage 40 and a recording head 39. The carriage 40 is supported to be reciprocatively movable in the left-right direction 9 by guide rails 43, 44 provided on the back side and the front side of the platen 42. A known belt mechanism is provided for the guide rail 44. The carriage 40 is connected to an endless belt of the belt mechanism. The carriage 40 reciprocates in the left-right direction 9 along the guide rails 43, 44 in accordance with the rotation of the endless belt. When the carriage 40 and the recording head 39 face the platen 42 with a spacing distance intervening therebetween, the carriage 40, the recording head 39 and the platen 42 define a part of the straight passage 65B.

The recording head 39 is carried on the carriage 40. A plurality of unillustrated nozzles are formed on the lower surface of the recording head 39. Inks are supplied from ink cartridges (not depicted) to the recording head 39. The recording head 39 selectively discharges the inks as minute ink droplets from the plurality of nozzles. When the carriage 40 is moved in the left-right direction 9, the ink droplets are discharged from the nozzles to the recording sheet S supported by the platen 42. The discharged ink droplets adhere to the recording sheet S on the platen 42, and thus an image is recorded on the recording sheet S.

<Bypass Route 182>

As depicted in FIG. 2, an opening 184 is provided above the back surface cover 22 on the back surface of the casing 14. The bypass route 182, which extends from the opening 184 to the first conveyance roller pair 59, is formed in the casing 14. The bypass route 182 extends from the upper backward to the lower frontward in the casing 14. The bypass route 182 is defined by the guide member 31, the outer guide member 18 and the back surface cover 22. The guide member 31 constitutes an upper guide surface when the recording sheet S is conveyed via the bypass route 182. The outer guide member 18 and the back surface cover 22 constitute a lower guide surface when the recording sheet S is conveyed via the bypass route 182. Both of the curved passage 65A and the straight passage 65B of the conveyance path 65 are arranged under or below the bypass route 182. Each of the outer guide member 18 and the back surface cover 22 is allowed to swing so that the upper side thereof is inclined backward, and thus a part of the bypass route 182 is open (exposed) to the outside of the casing 14 together with a part of the conveyance path 65.

The recording sheets S placed on a bypass tray 71 described later on are each guided obliquely downward via the bypass route 182. Each of the recording sheets S is guided via the straight passage 65B of the conveyance route 65 and conveyed by the first conveyance roller pair 59. Then, the image recording is performed on the recording sheet S by the recording unit 24 and the recording sheet S is discharged on the discharge tray 21. In this way, the recording sheets S placed on the bypass tray 71 are each conveyed via the route having a substantially straight shape (route in which the front surface and the back surface of the recording sheet S are not turned over in the up-down direction 7).

<Feed Apparatus 70>

Figure 5:
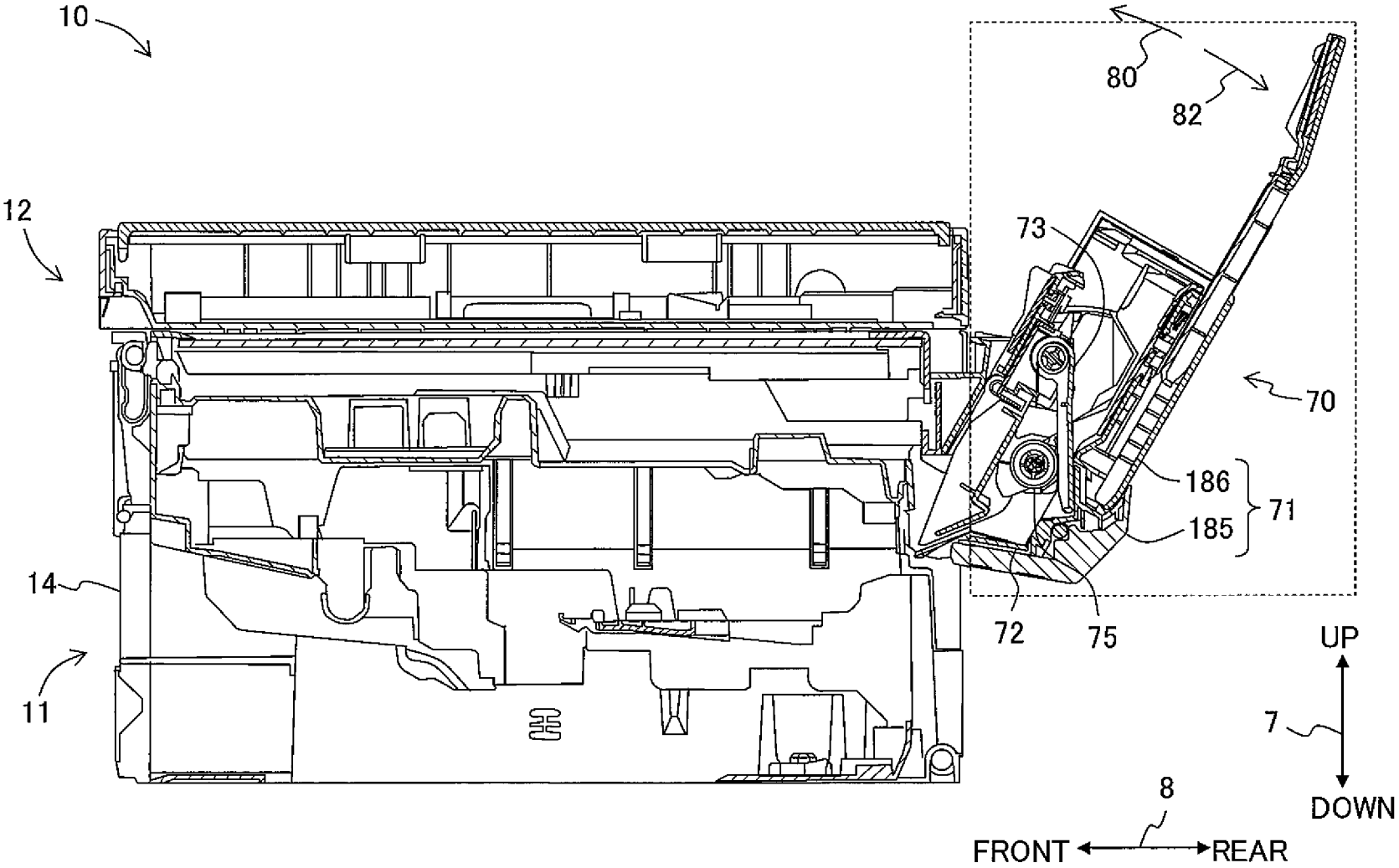
FIG. 5 is a vertical cross-sectional view of the multifunction peripheral 10 in which a holding arm 73 is positioned at a first position.
Figure 6:
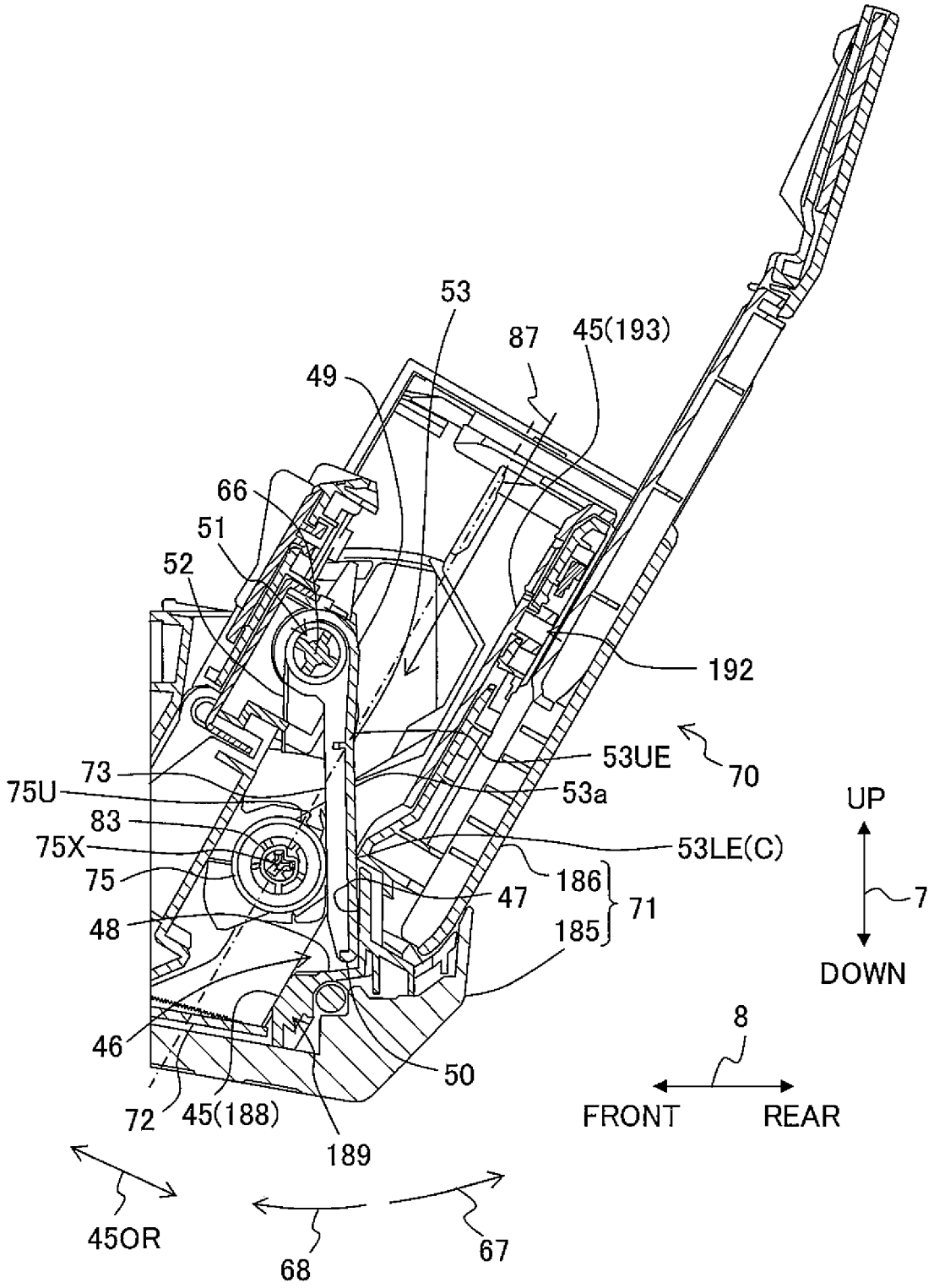
FIG. 6 is an enlarged view of a part enclosed in the rectangular frame depicted by dotted lines in FIG. 5.
Figure 7:
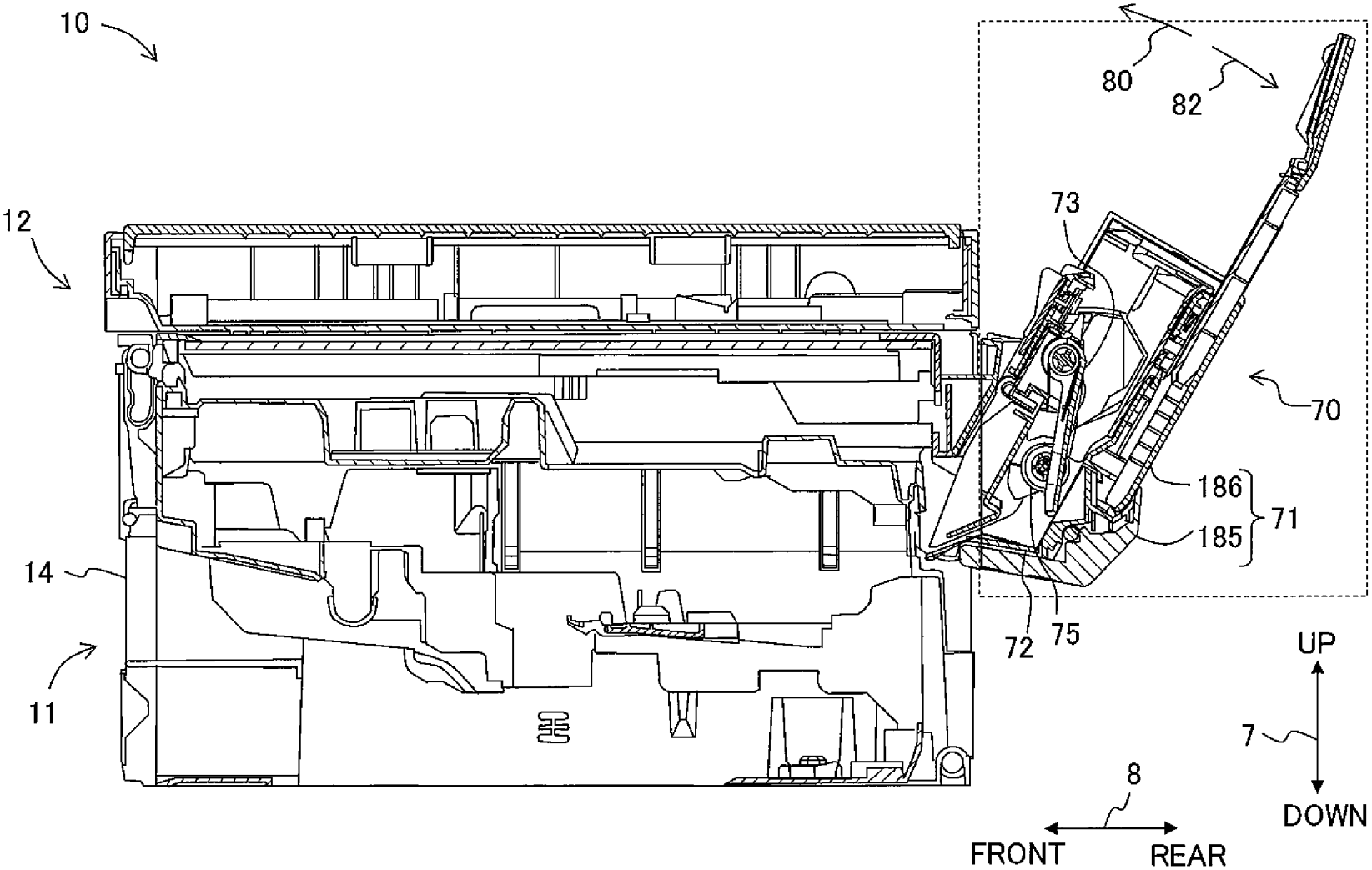
FIG. 7 is a vertical cross-sectional view of the multifunction peripheral 10 in which the holding arm 73 is positioned at a second position.

As depicted in FIGS. 5 and 6, the printer unit 11 includes a feed apparatus 70. The feed apparatus 70 includes the bypass tray 71 (an exemplary support unit of the present teaching), a feed roller 75 (an exemplary feed roller of the present teaching), a feed arm 76 (an exemplary first arm of the present teaching), a motor for feed (not depicted), a driving transmission mechanism 79, a holding arm 73 (an exemplary second arm of the present teaching), a torsion spring 52 (an exemplary basing member of the present teaching), a sheet sensor 54 (an exemplary detecting unit of the present teaching) and a separation piece 72.

<Bypass Tray 71>

As depicted in FIGS. 1 and 5, the bypass tray 71 is provided on the back surface side of the multifunction peripheral 10. The bypass tray 71 can load the recording sheets S independently from the feed tray 20.

Figure 3:
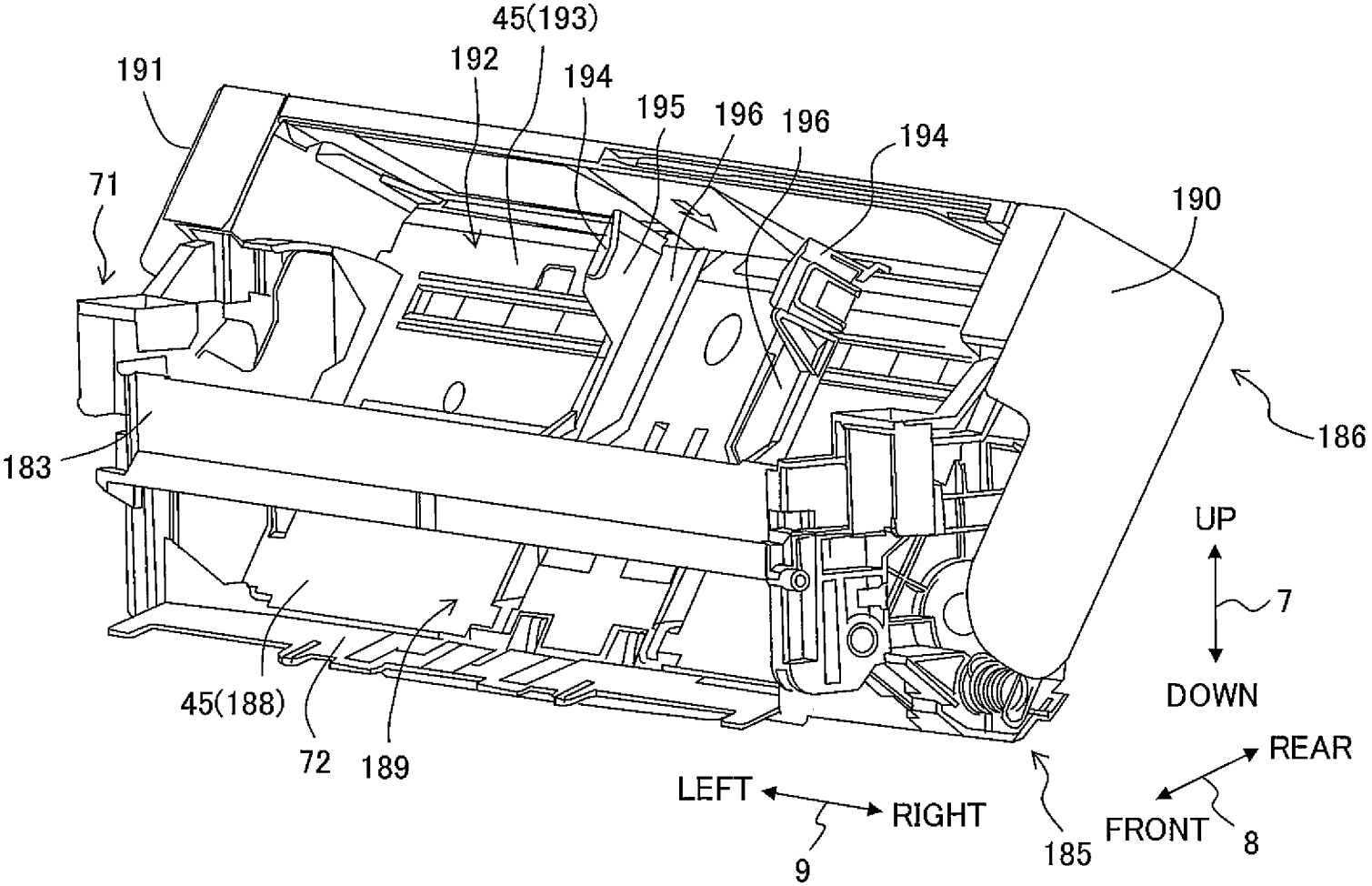
FIG. 3 is a perspective view of a bypass tray 71 in which the movable unit 186 is in an inclined or laid-down state.
Figure 4:
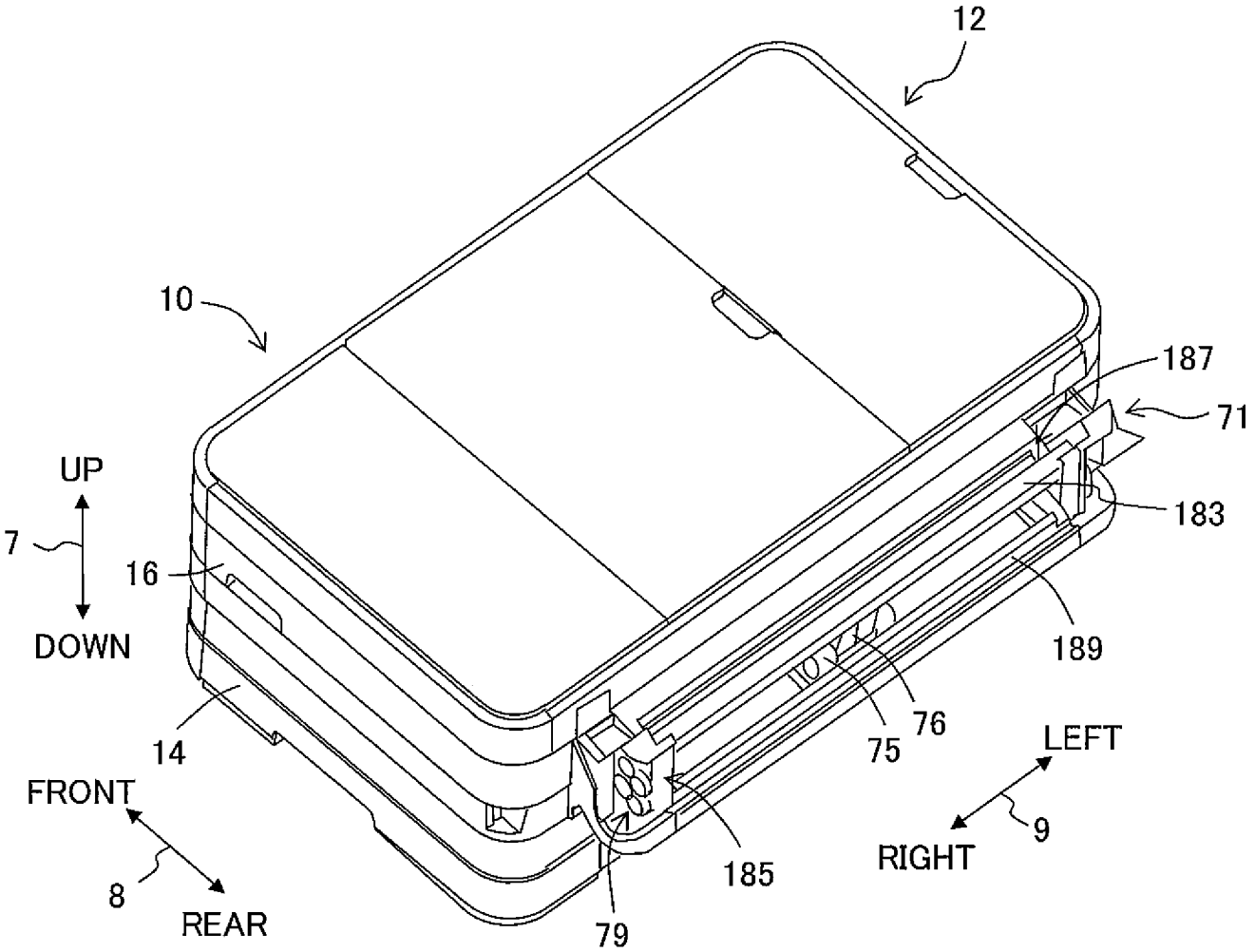
FIG. 4 is a perspective external view of the multifunction peripheral 10 on a back surface side in which the movable unit 186 is removed.

As depicted in FIGS. 1 and 4, a fixed unit 185, which extends downward to cover the opening 184 (see FIG. 2) therewith, is formed on the back surface side of the casing 16 of the scanner unit 12. The fixed unit 185 constitutes a part of the bypass tray 71 on the downstream side in the conveyance direction. As depicted in FIG. 3, a movable unit 186 is provided on the upper side of the fixed unit 185 so as to be swingable with respect to the fixed unit 185. The bypass tray 71 is constructed by the fixed unit 185 and the movable unit 186.

As depicted in FIG. 4, a slit-shaped opening 187, which extends in the left-right direction 9, is formed on the upper surface of the fixed unit 185. In the bypass tray 71, a passage is formed via the opening 187 to arrive at the bypass route 182 (see FIG. 2). As depicted in FIG. 3, a support member 189 including a support surface 188 is provided in the fixed unit 185. The support surface 188 extends obliquely downward to the bypass route 182 (see FIG. 2). The lower end of the support member 189 forms a part of the guide surface which guides the recording sheet S conveyed via the bypass route 182.

As depicted in FIGS. 2 and 3, the separation piece 72 is provided below the support member 189 of the fixed unit 185. The separation piece 72 is positioned at a height which is substantially the same as that of the opening 184 in the up-down direction 7. The upper surface of the separation piece 72 is a surface against which the forward ends of the recording sheets S supported by the bypass tray 71 abut. On the upper surface of the separation piece 72, a plurality of teeth are aligned in the front-rear direction 8 to project upward. The forward ends of recording sheets S supported by the bypass tray 71 are disentangled or unraveled (separated from one another) by the teeth. In FIG. 3, the illustration of the teeth is omitted.

As depicted in FIG. 3, a reinforcing member 183, which rotatably supports a rotational shaft 66 (see FIG. 6) of the feed arm 76, is provided above the support surface 188 on the upper end side of the support member 189. The driving force is transmitted from the motor for feed (not depicted) to the rotational shaft 66 supported by the reinforcing member 183 via the driving transmission mechanism 79, and thus the feed roller 75 is allowed to rotate.

As depicted in FIG. 4, the driving transmission mechanism 79, which is composed of a plurality of pinion gears, is provided on the right side of the fixed unit 185 in the left-right direction 9. The driving force is transmitted to the driving transmission mechanism 79 from the motor for feed (not depicted) provided at the inside of the casing 14 of the printer unit 11. The rotational shaft 66 extends in the left-right direction 9, and one end thereof is meshed or engaged with the pinion gears constituting the driving transmission mechanism 79. The other end of the rotational shaft 66 extends to the center of the fixed unit 185 in the left-right direction 9.

The rotational shaft 66 swingably supports the feed arm 76. That is, the feed arm 76 is swingable around the rotational shaft 66. The feed roller 75 is rotatably supported by the feed arm 76 on the side of a swing forward end (an end which is not supported by the rotational shaft 66). The feed arm 76 extends downward from the rotational shaft 66 toward the support surface 188 of the support member 189. The feed arm 76 is arranged at the center of the fixed unit 185 in the left-right direction 9. The structure of the feed arm 76 will be explained in detail below.

The feed roller 75 is connected to the rotational shaft 66 by an undepicted gear train. The rotation of the rotation shaft 66 is transmitted to the feed roller 75 via the endless belt to rotate the feed roller 75. The feed roller 75 is rotated in a state of being allowed to abut against the recording sheet S disposed on the uppermost side of the recording sheets S supported by the support surface 188, and thus the uppermost recording sheet S is fed via the bypass route 182 in a feed direction 87 (one direction from the bypass tray 71 to the discharge tray 21. see FIG. 6). The recording sheets S, which are disposed on the lower side of the uppermost recording sheet S, are disentangled or unraveled by the separation piece 72 and they are retained in the bypass tray 71 without being dragged by the recording sheet S disposed on the uppermost side. In this way, a feed unit, which is constructed by the feed roller 75, the rotational shaft 66 and the feed arm 76, is arranged in a space above the support surface 188 at the outside of the casing 14. The structure of the feed roller 75 will be explained in detail below.

As depicted in FIGS. 3 and 4, the movable unit 186 is provided on the upper side of the fixed unit 185 to be swingable with respect to the fixed unit 185. The movable unit 186 is swingable between the upstanding state in which the movable unit 186 upstands in the up-down direction 7 as depicted in FIG. 1 and the inclined or laid-down state in which the movable unit 186 is inclined with respect to the up-down direction 7 as depicted in FIG. 5.

The upstanding state is a state for reducing the space for the movable unit 186 on the back surface side of the casing 14. The bypass tray 71 is not used when the movable unit 186 is in the upstanding state. The back surface of the movable unit 186 in the upstanding state is substantially parallel to the back surface of the casing 14. When the movable unit 186 is in the upstanding state, the swing forward end of the movable unit 186 is positioned above the swing proximal end of the movable unit 186. The inclined state is the state in which the movable unit 186 is inclined obliquely upwardly toward the outside of the casing 14, and thus the inclined support surfaces 188, 198 are substantially provided as one flat surface, and the inclined state is the state in which the bypass tray 71 can be used. In the inclined state, the distance between the swing forward end of the movable unit 186 and the back surface of the casing 14 is greater than the distance between the swing proximal end of the movable unit 186 and the back surface of the casing 14. Whether the movable unit 186 is allowed to be in the upstanding state or the inclined state can be arbitrarily selected in accordance with the operation of a user.

As depicted in FIG. 3, side walls 190, 191 are provided on both sides of the movable unit 186 in the left-right direction 9. The side walls 190, 191 cover parts of the both sides of the fixed unit 185 in the left-right direction 9. The driving transmission mechanism 79, which is provided on the right side of the fixed unit 185 in the left-right direction 9, is covered with the side wall 190 of the movable unit 186.

As depicted in FIG. 3, a support member 192 is provided to span the side walls 190, 191 of the movable unit 186. In the inclined state of the movable unit 186, the support surface 193 provided on the upper surface of the support member 192 and the support surface 188 form substantially the same flat surface. Thus, a surface 45 (an exemplary support surface of the present teaching), which is formed by the support surface 188 of the support member 189 and the support surface 193 of the support member 192, supports the recording sheet S in the bypass tray 71. In the upstanding state of the movable unit 186, the support surface 193 is perpendicular to the placement surface for the multifunction peripheral 10; in other words, the support surface 193 extends in the up-down direction 7 and the left-right direction 9. In this embodiment, the placement surface on which the multifunction peripheral 10 is placed is a surface which expands in the left-right direction 9 and the front-rear direction 8. Here, "substantially one flat surface (the same flat surface)" means a flat surface on which the supported recording sheet S is neither bent nor flexed even when there is a small difference in height between two surfaces constituting the flat surface; in other words, it means a flat surface on which the recording sheet S is supported so that separation performance is stably obtained by the separation piece 72.

As depicted in FIG. 3, the support member 192 is provided with a pair of side guides 194. The side guides 194 are separated from each other in the left-right direction 9 to form a pair, and the side guides 194 protrude upward from the support surface 193. The side guide 194 includes a guide surface 195 which extends in the conveyance direction of the recording sheet S in the bypass tray 71. When the recording sheet S on the support surface 193 is conveyed, the side edge of the recording sheet S in the conveyance direction is guided by the guide surface 195.

The side guide 194 has a support surface 196 along the support surface 193 of the support member 192. That is, the side guide 194 is L-shaped in which the guide surface 195 is orthogonal to the support surface 196. Although there is a small difference in height between the support surfaces 193, 196, the support surface 196 is substantially flush with the support surface 193. The support surface 196 supports the recording sheet S with the support surfaces 188, 193. The distance, by which the side guides 194 are separated from each other in the left-right direction 9, is variable. Accordingly, the side edges of the recording sheets S having various sizes supported by the support surfaces 193, 196 can be guided by the guide surface 195 of the side guide 194.

Figure 9:
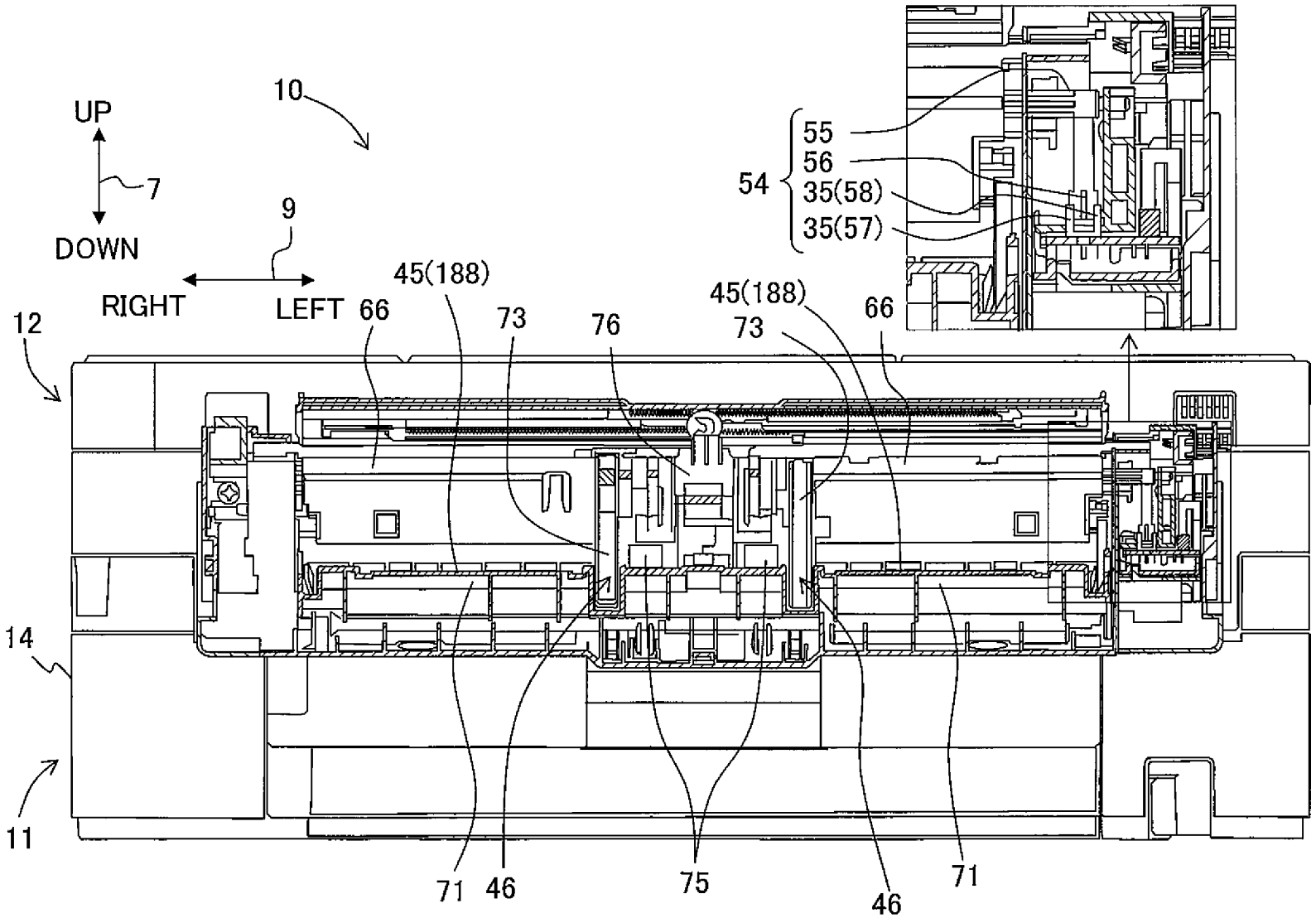
FIG. 9 is a back view of the multifunction peripheral 10.

As depicted in FIGS. 6 and 9, two recess portions 46 are provided in the surface 45 (support surface 188 of the support member 189) of the bypass tray 71. The other end 50 of the holding arm 73 described later on is inserted into the recess portion 46. The two recess portions 46 are arranged at the same position in the feed direction 87. Further, the two recess portions 46 are respectively arranged on the right side and left side of the feed rollers 75 in the left-right direction 9. That is, the two recess portions 46 are provided as a pair to interpose the feed rollers 75 therebetween.

As depicted in FIG. 6, the recess portion 46 includes a first inclined surface 47 and a second inclined surface 48. The first inclined surface 47 constitutes the upstream side of the recess portion 46 in the feed direction 87. The first inclined surface 47 is inclined so that the first inclined surface 47 is separated farther from the support surface 188 toward the downstream side in the feed direction 87. The inclination angle of the first inclined surface 47 is substantially the same as the inclination angle of the holding arm 73 positioned at a first position.

The second inclined surface 48 constitutes the downstream side of the recess portion 46 in the feed direction 87. The second inclined surface 48 is continued to the downstream end of the first inclined surface 47 in the feed direction 87 and the second inclined surface 48 is inclined so that the second inclined surface 48 is closer to the support surface 188 toward the downstream side in the feed direction 87.

The shape of the recess portion 46 is not limited to a shape partitioned or defined by the first inclined surface 47 and the second inclined surface 48, provided that the other end 50 of the holding arm 73 is insertable into the recess portion 46. For example, the recess portion 46 may be recessed to have a rectangular shape.

<Feed Roller 75 and Feed Arm 76>

As depicted in FIG. 6, the feed roller 75 is arranged on the frontward side of the bypass tray 71. The feed roller 75 can abut against the support surface 188 of the support member 189. A rotational shaft 83 of the feed roller 75 extends in the left-right direction 9. Although two feed rollers 75 are provided with a spacing distance intervening therebetween in the left-right direction 9 in this embodiment as depicted in FIG. 9, the number of feed rollers 75 is not limited to two.

The feed arm 76 extends to be inclined with respect to the support surface 188 on the upper side of the support surface 188. The feed arm 76 is configured to extend from its one end so that the feed arm 76 is separated farther from the surface 45 of the bypass tray 71 toward the upstream side in the feed direction 87. The feed roller 75 is supported via the rotational shaft 83 at one end of the feed arm 76, and the feed roller 75 is rotatable about a rotation center 75X. The rotational shaft 66 is inserted through a hole provided at an upstream-side end of the feed arm 76 in the feed direction 87; in other words, a hole provided at the other end of the feed arm 76. Accordingly, the feed arm 76 swings in the directions of the arrows 67, 68 with the rotational shaft 66 as a swing center. Thus, the feed arm 76 is swingable with the other end of the feed arm 76 as the swing shaft. As a result, the feed roller 75 can abut against the support surface 188 of the support member 189 or the recording sheet S supported by the support surface 188 and the feed roller 75 can be separated therefrom. As described above, the rotational shaft 66 is rotatably supported by the reinforcing member 183.

The feed arm 76 is connected to the rotational shaft 66 by an unillustrated torsion spring. Accordingly, the feed arm 76 is biased by the torsion spring in the direction of the arrow 67. The structure for basing the feed arm 76 in the direction of the arrow 67 is not limited to a structure using the torsion spring. For example, a coil spring may be arranged on the frontward side of the feed arm 76 such that one end of the coil spring is connected to the feed arm 76 and the other end of the coil spring is connected to a frame of the printer unit 11. The feed arm 76 may be biased by the coil spring in the direction of the arrow 67.

In this embodiment, the feed arm 76 can be swung with the driving force applied from a contact-separating mechanism. The structure of the contact-separating mechanism may be any publicly known structure on condition that the feed arm 76 can be swung in the directions of the arrows 67, 68. When the recording sheet S supported by the bypass tray 71 is fed, the contact-separating mechanism causes the feed arm 76 to swing in the direction of the arrow 67 so that the feed roller 75 abuts against the recording sheet S supported by the surface 45. On the other hand, when the recording sheet S supported by the bypass tray 71 is not fed, the contact-separating mechanism causes the feed arm 76 to swing in the direction of the arrow 68 so that the feed roller 75 is separated from the support surface 188 of the support member 189. In FIGS. 6 to 13, the feed roller 75 is separated from the support surface 188 by the contact-separating mechanism.

<Holding Arm 73>

As depicted in FIG. 6, similar to the feed arm 76, the holding arm 73 extends above the support surface 188 and the holding arm 73 is configured to extend from one end 49 so that the holding arm 73 is closer to the support surface 188 of the support member 189 toward the downstream side in the feed direction 87. That is, the one end 49 of the holding arm 73 is positioned at the upstream side of the other end 50 in the feed direction 87, and the distance between the one end 49 and the surface 45 is greater than the distance between the other end 50 and the surface 45. The rotational shaft 66 is inserted through a hole 51 provided on the side of the upstream-side end of the holding arm 73 in the feed direction 87; in other words, a hole 51 provided on the side of the one end 49. Accordingly, the holding arm 73 swings in the directions of the arrows 67, 68 with the rotational shaft 66 as a swing center, in the same manner as the feed arm 76. Thus, the holding arm 73 is swingable with the side of the one end 49 as the swing shaft and the side of the other end 50 as the side of the forward end of the swing. As a result, the side of the forward end of the holding arm 73 can abut against the support surface 188 or the recording sheet S supported by the support surface 188 and the side of the forward end of the holding arm 73 can be separated therefrom.

As described above, the rotational shaft 66 is inserted through both the feed arm 76 and the holding arm 73. Therefore, the center of the swing shaft of the feed arm 76 is the same as the center of the swing shaft of the holding arm 73. Further, the feed arm 76 and the holding arm 73 are swingable independently from each other.

As depicted in FIG. 6, the other end 50 of the holding arm 73 is curved to be convex toward the downstream side in the feed direction 87 as viewed from the left side or the right side (the far side or the near side in the vertical direction with respect to the paper surface). That is, the surface of the holding arm 73 which is directed to the upstream side in the feed direction 87 smoothly curves into the downstream side in the feed direction 87 at the other end 50.

The number of holding arms 73 provided is the same as the number of the recess portions 46 provided for the support surface 188 of the support member 189. That is, in this embodiment, the holding arms 73 are provided as a pair. Each of the holding arms 73 is arranged on the right side or the left side of the feed rollers 75.

Each of the holding arms 73 corresponds to one of the two recess portions 46. As depicted in FIG. 9, the holding arms 73 are disposed to interpose the feed rollers 75 therebetween in the left-right direction 9, which is orthogonal to the feed direction 87 and extends along the support surface 188.

Figure 8:
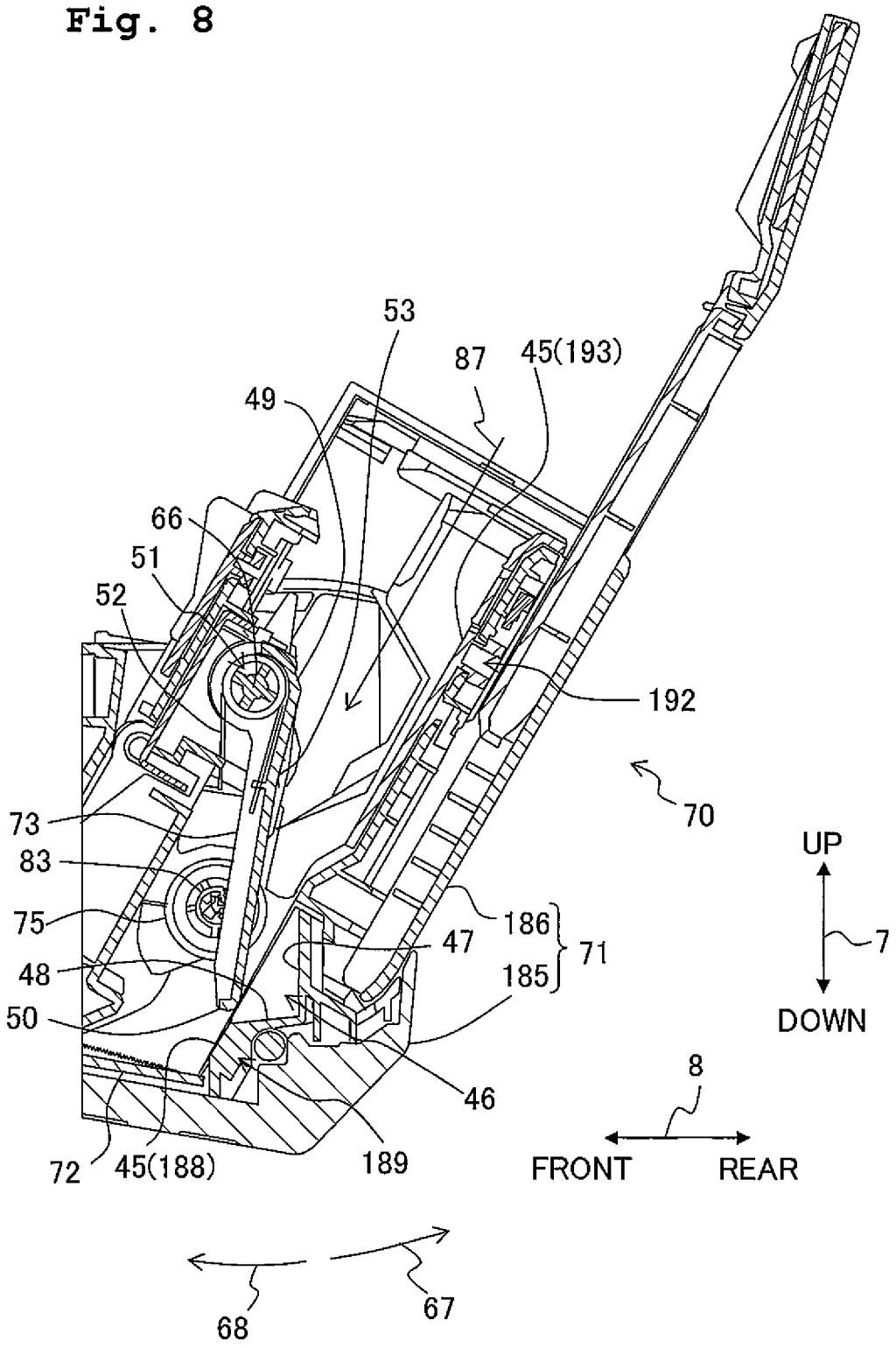
FIG. 8 is an enlarged view of a part enclosed in the rectangular frame depicted by dotted lines in FIG. 7.

As depicted in FIG. 9, the width of the other end 50 of the holding arm 73 in the left-right direction 9 is narrower than the width of the corresponding recess portion 46. Accordingly, as depicted in FIG. 6, the other end 50 of the holding arm 73 is capable of entering the recess portion 46. The position of the holding arm 73 in this situation, i.e., the position of the holding arm 73 in the state depicted in FIG. 6 corresponds to the first position of the preset teaching. On the other hand, as depicted in FIG. 8, the holding arm 73 in the first position is swung in the direction of the arrow 68, and thus the other end 50 of the holding arm 73 is retractable from the recess portion 46. The position of the holding arm 73 in this situation, i.e., the position of the holding arm 73 in the state depicted in FIG. 8 corresponds to a second position of the present teaching. Accordingly, the holding arm 73 is swingable between the first position and the second position.

As depicted in FIG. 6, when the holding arm 73 is positioned at the first position, a surface 53 (an exemplary guide surface of the present teaching) is positioned on the upstream side of the feed roller 75 in the feed direction 87. The surface 53 is a part which is included in the surface of the holding arm 73 on the upstream side in the feed direction 87 and does not enter the recess portion 46 (i.e., a part extending toward the upstream side in the feed direction 87 from the position C at which the holding arm 73 intersects with the surface 45), when the holding arm 73 is positioned at the first position.

As depicted in FIG. 8, when the holding arm 73 is positioned at the second position, the other end 50 of the holding arm 73 is positioned on the downstream side of the feed roller 75 in the feed direction 87. More specifically, when the holding arm 73 is positioned at the second position, the other end 50 of the holding arm 73 is positioned on the downstream side in the feed direction 87 of the rotation center 75X of the feed roller 75 abutting against the recording sheet S supported by the support surface 188.

The holding arm 73 is connected to the rotational shaft 66 by the torsion spring 52. Accordingly, the holding arm 73 is biased by the torsion spring 52 in the direction of the arrow 67, i.e., toward the first position. The structure for basing the holding arm 73 in the direction of the arrow 67 is not limited to a structure using the torsion spring 52. For example, a coil spring may be arranged on the frontward side of the holding arm 73 such that one end of the coil spring is connected to the holding arm 73 and the other end of the coil spring is connected to the frame of the printer unit 11. The holding arm 73 may be biased in the direction of the arrow 67 by the coil spring.

<Sheet Sensor 54>

As depicted in FIG. 9, a sheet sensor 54 is provided on the left side of the bypass tray 71. The sheet sensor 54 includes an extending unit 55 extending leftward from the holding arm 73 positioned at the left side, a detector 56 protruding from the left end of the extending unit 55 toward the direction in which the holding arm 73 extends from the extending unit 55, and an optical sensor 35 which has a light-emitting element 57 and a light-receiving element 58 receiving the light emitted from the light-emitting element 57.

The swing of the holding arm 73 positioned on the left side causes the detector 56 to swing integrally with the holding arm 73 positioned on the left side with the extending unit 55 as a swing center.

When the holding arm 73 is positioned at the first position, as depicted in FIG. 9, the projecting forward end of the detector 56 enters between the light-emitting element 57 and the light-receiving element 58 of the optical sensor 35; in other words, the projecting forward end of the detector 56 enters an optical path extending from the light-emitting element 57 to the light-receiving element 58. This blocks the light passing through the optical path. In this situation, a low level signal is output from the optical sensor 35 to an controller (not depicted) controlling the operation of the multifunction peripheral 10. On the other hand, when the holding arm 73 is positioned at the second position, the projecting forward end of the detector 56 is retracted from the optical path. This allows the light to pass through the optical path. In this situation, a high level signal is output from the optical sensor 35 to the controller. As described above, the sheet sensor 54 detects whether or not the detector 56 is positioned in the optical path to let the controller detect the position of the holding arm 73 (i.e., whether the holding arm 73 is positioned at the first position or the second position).

The direction in which the detector 56 protrudes may be a direction different from the extending direction of the holding arm 73. Further, contrary to the above, the projecting forward end of the detector 56 may enter the optical path when the holding arm 73 is positioned at the second position, and the projecting forward end of the detector 56 may be retracted from the optical path when the holding arm 73 is positioned the first position.

The sheet sensor 54 may be provided on the right side of the holding arm 73. In this case, the extending unit 55 is made to extend rightward from the holding arm 73 positioned on the right side.

<Operation of Feed Apparatus 70>

In the following, an explanation will be made about the operation of the feed apparatus 70 in a process in which the recording sheet S is supported by the bypass tray 71. An explanation will be made especially in detail for the operation of the holding arm 73 of the feed apparatus 70.

As depicted in FIG. 6, in a state that no recording sheet S is supported by the surface 45 of the bypass tray 71, the holding arm 73 is positioned at the first position by being biased by the torsion spring 52. In this situation, the other end 50 of the holding arm 73 enters the recess portion 46. Further, the side of the other end 50 of the holding arm 73 abuts against the first inclined surface 47 constituting the recess portion 46.

In the above situation, when a recording sheet S is inserted into the feed apparatus 70 via the opening 187 (see FIG. 4) by a user of the multifunction peripheral 10 and the like, the forward end of the recording sheet S in the insertion direction abuts against the surface 53 of the holding arm 73 positioned at the first position, as depicted in FIG. 10.

In the state depicted in FIG. 10, when the recording sheet S is inserted (pushed) further in the feed direction 87 by the user and the like, the holding arm 73 is pushed by the recording sheet S and thus the holding arm 73 is swung in the direction of the arrow 68 against the biasing force of the torsion spring 52. That is, the holding arm 73 swings from the first position to the second position. Accordingly, the side of the other end 50 of the holding arm 73 is separated from the first inclined surface 47.

Meanwhile, the recording sheet S inserted (pushed) further in the feed direction 87 by the user and the like is guided to the downstream side in the feed direction 87 along the surface 53 of the holding arm 73 while the holding arm 73 is pushed upward by the recording sheet S. Accordingly, the forward end of the recording sheet S in the insertion direction is moved toward the other end 50 of the holing arm 73 along the surface 53. As a result, the forward end of the recording sheet S in the insertion direction is guided between the feed roller 75 and the support surface 188 of the support member 189, as depicted in FIG. 11.

Figure 11:
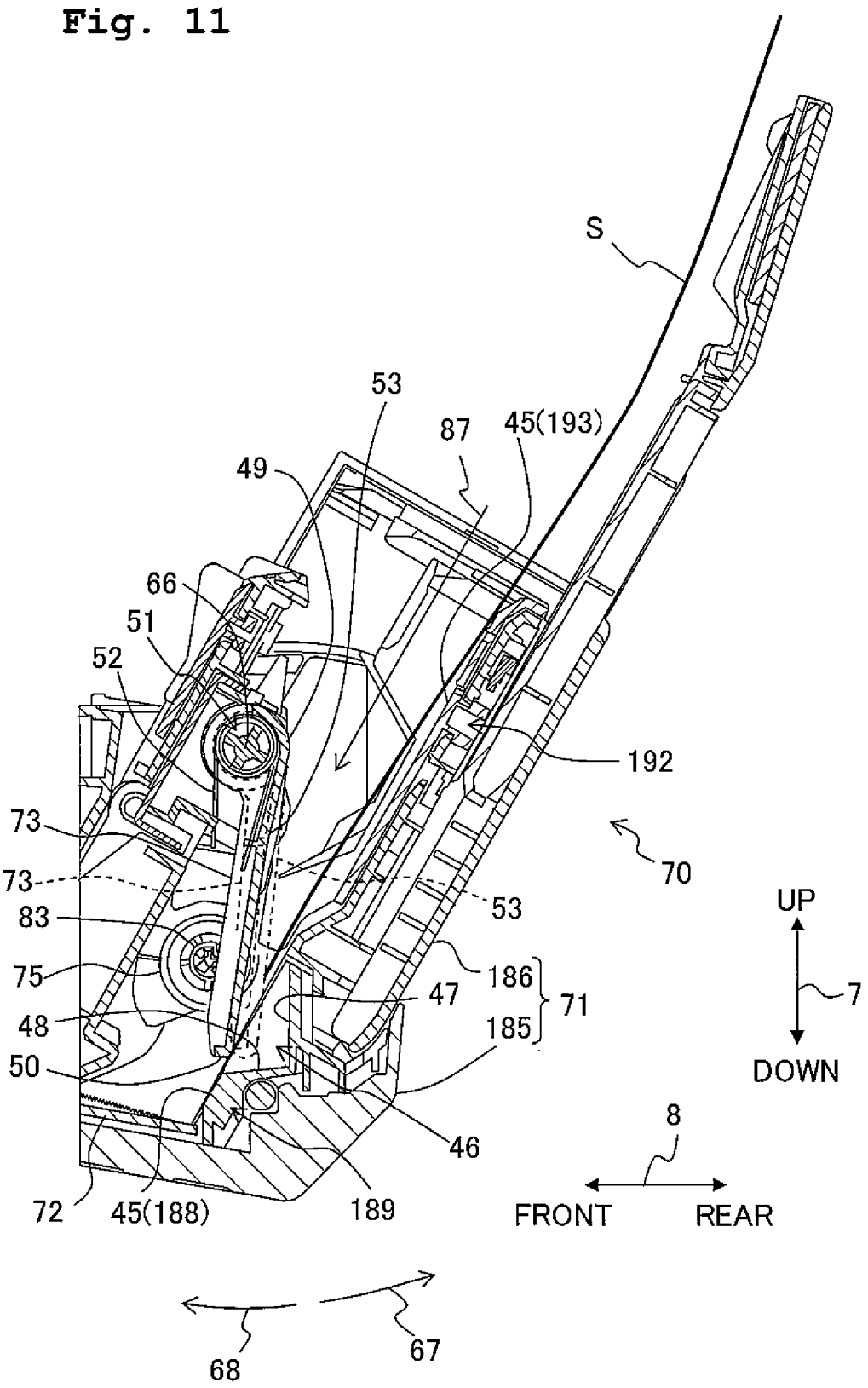
FIG. 11 is an enlarged view of the part enclosed in the rectangular frame depicted by dotted lines in FIG. 7 showing a state that the forward end of a recording sheet in the insertion direction is positioned between a feed roller 75 and a support surface 188.

In the state depicted in FIG. 11, the feed arm 76 is swung in the direction of the arrow 68 by the contact-separating mechanism and the feed roller 75 is separated from the support surface 188. Thus, the forward end of the recording sheet S in the insertion direction can pass between the feed roller 75 and the support surface 188 without coming into contact with the feed roller 75.

Figure 12:
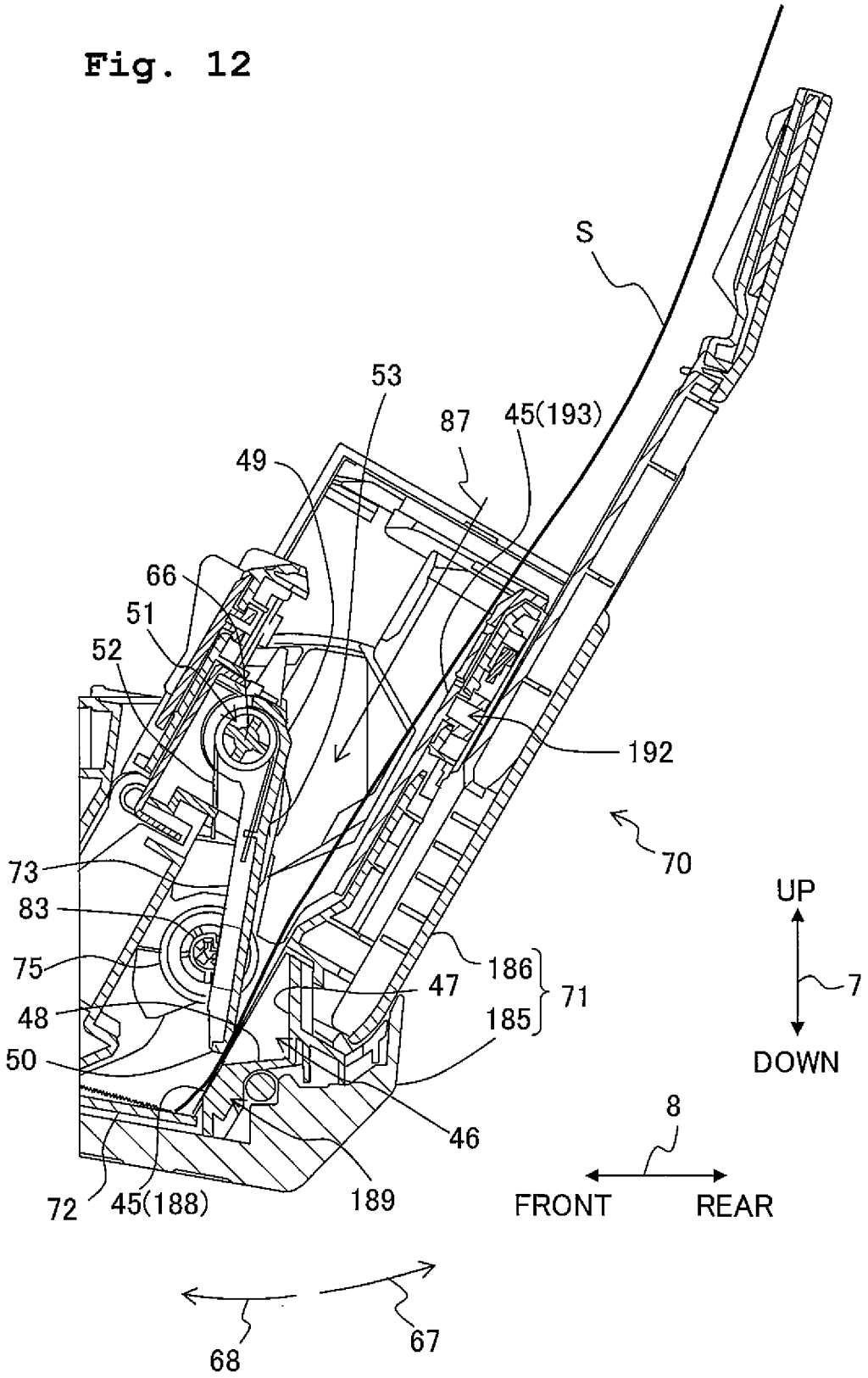
FIG. 12 is an enlarged view of the part enclosed in the rectangular frame depicted by dotted lines in FIG. 7 showing a state that the forward end of a recording sheet in the insertion direction abuts against a separation piece 72.

In the state depicted in FIG. 11, when the recording sheet S is inserted (pushed) further in the feed direction 87 by the user and the like, the forward end of the recording sheet S in the insertion direction passes through the other end 50 of the holding arm 73. Then, the holding arm 73 is retracted from the recess portion 46 to arrive at the second position. After that, as depicted in FIG. 12, the forward end of the recording sheet S in the insertion direction abuts against the separation piece 72. In this situation, the recoding sheet S is pressed against the support surface 188 of the support member 189 by the holding arm 73 at a position closer to the separation piece 72 than the feed roller 75 (a position between the feed roller 75 and the separation piece 72, the downstream side of the feed roller 75 in the feed direction 87). Further, the recoding sheet S is pressed against the support surface 188 of the support member 189 by the holding arm 73 at a position between the separation piece 72 and the rotation center 75X of the feed roller 75 abutting against the recording sheet S (the downstream side in the feed direction 87 of the rotation center 75X of the feed roller 75 abutting against the recording sheet S).

In the state depicted in FIG. 12, when the instruction of image recording on the recording sheet S is issued by the user through the operation of an operation unit (not depicted) provided for the multifunction peripheral 10, the controller controls the contact-separating mechanism to swing the feed arm 76 in the direction of the arrow 67. Accordingly, the feed roller 75 abuts against the recording sheet S supported by the surface 45 of the bypass tray 71. Further, the controller controls the motor for feed to apply the driving force to the feed roller 75 via the driving transmission mechanism 79. Then, the feed roller 75 is rotated to feed the recording sheet S in the feed direction 87. As a result, the recording sheet S enters the straight passage 65B via the bypass route 182. Then, the recording sheet S having an image recorded by the recording unit 24 is discharged on the discharge tray 21 by the second conveyance roller pair 180.

Effects of Embodiment

According to this embodiment, in a state that no recording sheet S is supported by the surface 45 of the bypass tray 71, the holding arm 73 is positioned at the first position by being biased by the torsion spring 52. In this situation, when one recording sheet S or a plurality of recording sheet S is/are allowed to enter the feed apparatus 70 from the upstream side in the feed direction 87 so that the recording sheet S is supported by the surface 45, the recording sheet S abuts against the surface 53 of the holding arm 73 first. In other words, the recording sheet S does not abut against the feed roller 75 first. Here, many of the feed rollers 75 have a roller surface made of rubber, and the recording sheet S coming into contact with the roller surface is more likely to be bent. In this structure, however, the recording sheet S does not abut against the feeing roller 75 first, and thus the possibility that the recording sheet S entering the feed apparatus 70 is bent can be reduced.

Subsequently, the recording sheet S entering the feed apparatus 70 is guided to the downstream side in the feed direction 87 along the surface 53 of the holding arm 73. In this situation, the holding arm 73 is pushed by the recording sheet S, which causes the holding arm 73 to swing from the first position to the second position against the biasing force of the torsion spring 52. Accordingly, the recording sheet S can be guided between the feed roller 75 and the support surface 188 of the support member 189.

The other end 50 of the holding arm 73 at the second position is positioned on the downstream side of the feed roller 75 in the feed direction 87. That is, the recording sheet S, which has been guided by the holding arm 73 and has passed between the feed roller 75 and the support surface 188, is in a state of being held toward the support surface 188 by the other end 50 of the holding arm 73. Thus, according to this embodiment, the recording sheet S can be held toward the support surface 188 on the downstream side of the feed roller 75 in the feed direction 87. Thus, the possibility of occurrence of the overlapped feed of recording sheets S can be reduced as compared with a case where the recording sheet S is held toward the support surface 188 only by the feed roller 75.

If the holding arm 73 is provided at only one of the left side and the right side of the feed roller 75, pressure is applied only on one side of the feed roller 75 in the left-right direction 9 and no pressure is applied on the other side. Thus, the recording sheet S is more likely to skew. According to this embodiment, however, since the recoding sheet S is held by the holding arms 73 on both sides of the feed roller 75, the possibility of occurrence of skew of the recording sheet S can be reduced.

According to this embodiment, in a state no recording sheet S is supported by the bypass tray 71, the holding arm 73 is positioned at the first position by being biased by the torsion spring 52. In a state that the recording sheet S is supported by the bypass tray 71, the holding arm 73 is positioned at the second position by being pushed by the recording sheet S. That is, the sheet sensor 54 can detect whether or not the recording sheet S is supported by the bypass tray 71 based on the position of the holding arm 73. Thus, according to this embodiment, since the holding arm 73 can function also as the detector 56, which is detected by the sheet sensor 54 for detecting as to whether or not the recording sheet S is supported, it is unnecessary to provide any exclusive detector for detecting the recording sheet S in the feed apparatus 70.

According to this embodiment, since the center of the swing shaft of the feed arm 76 is the same as the center of the swing shaft of the holding arm 73, it is unnecessary to provide the swing shafts of the feed arm 76 and the holding arm 73 individually. Thus, it is possible to simplify the structure of the feed arm 76 and the holding arm 73.

According to this embodiment, since the other end 50 of the holding arm 73 is curved, when the recording sheet S entering the feed apparatus 70 passes through the downstream side of the holding arm 73 in the feed direction 87, the recording sheet S is less likely to be bent by abutting against the other end 50 of the holding arm 73.

Modified Embodiments

Figure 13:
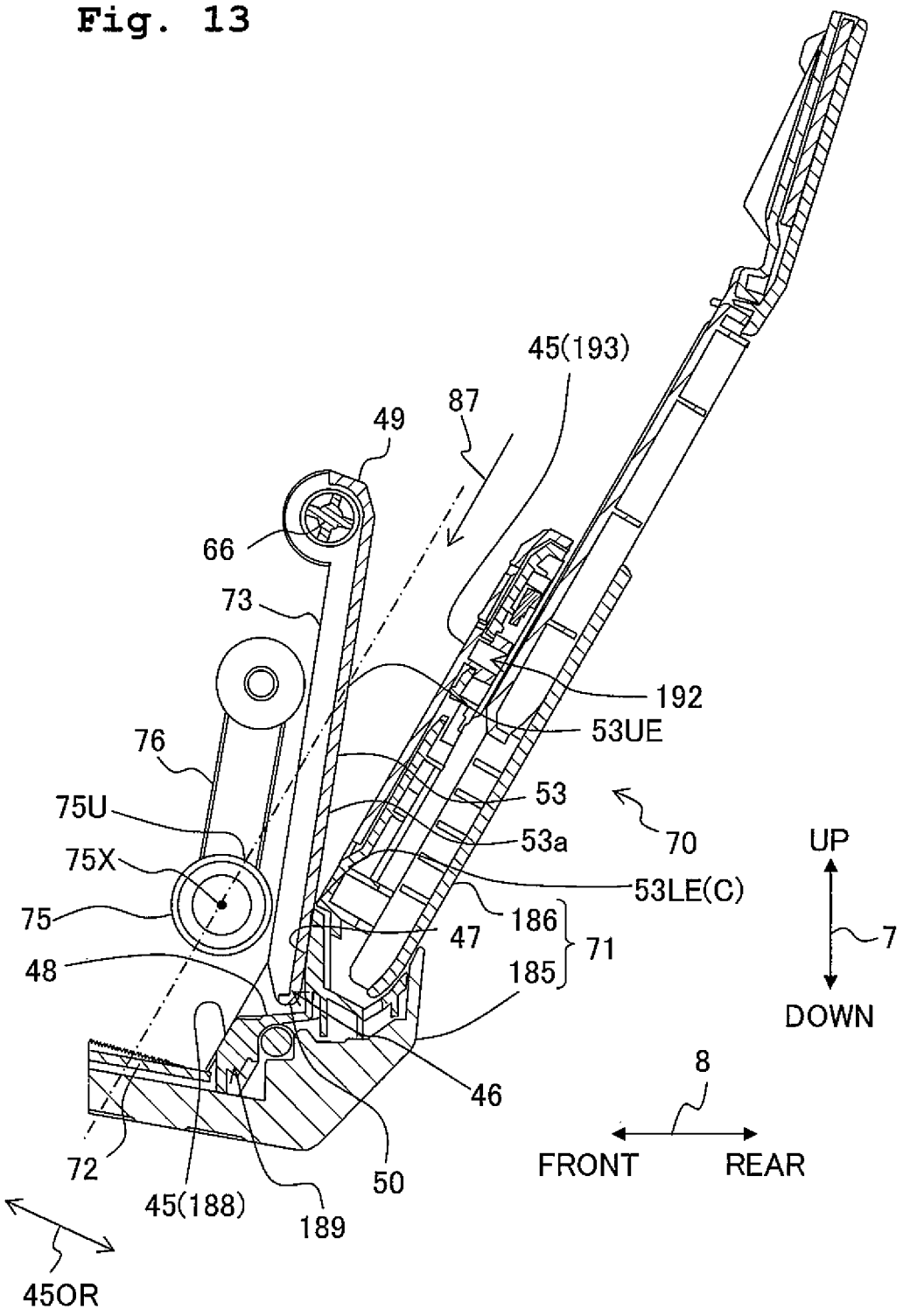
FIG. 13 is a vertical cross-sectional view showing the circumference of the feed arm 76 and the holding arm 73 of the feed apparatus 70 in a modified embodiment.

In the above embodiment, the center of the swing shaft of the feed arm 76 is the same as the center of the swing shaft of the holding arm 73. As depicted in FIG. 13, however, the swing shaft of the holding arm 73 may be arranged on the upstream side of the swing shaft of the feed arm 76 in the feed direction 87.

According to the structure depicted in FIG. 13, as the swing shaft of the holding arm 73 is positioned closer to the upstream side in the feed direction 87 than the swing shaft of the feed arm 76, the recording sheet S entering the feed apparatus 70 can abut against the surface 53 of the holding arm 73 earlier. Further, it is possible to gentle the inclined angle of the holding arm 73 to the surface 45 of the bypass tray 71. Therefore, the recording sheet S can be guided along the surface 53 easily.

In the above embodiment, the number of recess portions 46 is two. However, the number of recess portions 46 is not limited to two. For example, only one recess portion 46 may be provided on the surface 45 of the bypass tray 71 at the right side of the feed roller 75. Or, three or more recess portions 46 may be provided in the left-right direction. It is preferred that the number of recess portions 46 be an even number and that the number of recess portions 46 provided on the left side of the feed roller 75 be the same as the number of recess portions 46 provided on the right side of the feed roller 75.

In the above embodiment, the number of holding arms 73 is two. However, the number of holding members 73 is not limited to two. For example, in a case that only one recess portion 46 is provided, only one holding arm 73 is provided corresponding to the one recess portion 46. Or, three or more holding arms 73 may be provided in the left-right direction. It is preferred that the number of holding arms 73 be an even number and that the number of holding arms 73 provided on the left side of the feed roller 75 be the same as the number of holding arms 73 provided on the right side of the feed roller 75. Further, in the above embodiment, in a case that the holding arm 73 is positioned at the first position, the surface 53 is positioned on the upstream side of the feed roller 75 in the feed direction 87, the surface 53 being a part which is included in the surface of the holding arm 73 on the upstream side in the feed direction 87 and does not enter the recess portion 46 (i.e., the part extending to the upstream side in the feed direction 87 from the position C at which the holding arm 73 intersects with the surface 45) The more specific explanation about this situation is as follows. That is, in the case that the holding arm 73 is positioned at the first position, a surface 53*a* (another example of the guide surface of the present teaching. FIG. 6) is positioned on the upstream side of the feed roller 75 in the feed direction 87. The surface 53*a* is a part which is included in the surface of the holding arm 73 on the upstream side in the feed direction 87, does not enter the recess portion 46, and is defined between the surface 45 and the rotation center 75X (FIG. 6) of the feed roller 75 positioned separate from the surface 45 in a direction 450R (FIG. 6) orthogonal to the surface 45. Alternatively, the surface 53*a* may be defined in the surface 53 by an upper side 53UE (see FIG. 6), a lower side 53LE (see FIG. 6), and an area sandwiched between the upper side 53UE and the lower side 53LE, the upper side 53UE being defined at a position which is the same as that of the rotation center 75X of the feed roller 75 positioned separate from the surface 45 in the direction 450R orthogonal to the surface 45 and the lower side 53LE being defined at a position which is the same as that of the surface 45 in the direction 450R orthogonal to the surface 45. In this case, the position of the surface 53*a* at the first position may be a positon at which the upper side 53UE of the surface 53*a* is positioned on the upstream side of an upstream-side end 75U (FIG. 6) of the feed roller 75 in the feed direction 87 and the surface 53*a* does not overlap with the feed roller 75 as viewed from the extending direction of the rotational shaft 83 of the feed roller 75 (the direction perpendicular to the paper surface of FIG. 6, the direction orthogonal to the feed direction 87 and extending along the surface 45).

In the above embodiments, the feed arm 76 rotatably supports the feed rollers at the one end and is swingably supported by the rotational shaft 66 at the other end. However, the feed arm 76 can rotatably support the feed rollers 75 at the position different from the one end thereof and can be swingably suppored by the rotational shaft 66 at the position different from the other end thereof.

In the above embodiment, the feed apparatus 70 is an apparatus for feeding the recording sheet S supported by the bypass tray 71. The feed apparatus 70, however, may be an apparatus for feeding the recording sheet S supported by the feed tray 20. That is, the feed apparatus 70 may include the feed tray 20, the feed unit 15, the holding arm 73 and the sheet sensor 54. In this case, the recess portion 46 is provided in the support surface of the feed tray 20. Further, the holding arm 73 is provided to face the recess portion 46 above the feed tray 20.

In the above embodiment, the feed apparatus 70 is provided in the printer unit 11. However, an apparatus for which the feed apparatus 70 is provided is not limited to the printer unit 11. For example, the feed apparatus 70 may be provided in the scanner unit 12. In this case, the feed apparatus 70 feeds a sheet having an image to be read by the scanner unit 12 into the scanner unit 12.

What is claimed is:

1. A feed apparatus, comprising:

a support unit including a support surface which is configured to support a sheet;

a feed roller configured to feed the sheet supported by the support surface in a feed direction;

an insert portion provided on the support surface;

an abutment arm configured to swing between a first position at which an end of the abutment arm is positioned in the insert portion and a second position at which the end of the abutment arm is positioned outside of the insert portion, a swing shaft of the abutment arm being provided on the support unit so that a position of the swing shaft of the abutment arm in the feed direction is fixed;

a separation piece which has an upper surface configured to separate the sheet fed in the feed direction from another sheet supported by the support surface; and a biasing member configured to bias the abutment arm toward the first position;

wherein the abutment arm is configured such that, in a case that the abutment arm is positioned at the first position, an end of the sheet, which is moved in the feed direction so that the sheet is placed on the support surface, is pushed by a portion of a surface of the abutment arm to the support surface prior to abutting the feed roller, the portion of the surface of the abutment arm being positioned outside of the insert portion and being positioned upstream of the feed roller in the feed direction, in a case that the abutment arm is positioned at the second position, the end of the abutment arm abuts an upper surface of the sheet supported by the support surface, a rotational shaft of the feed roller is positioned upstream of the upper surface of the separation piece in the feed direction, and the support unit includes a first unit having the support surface and a second unit on which the swing shaft of the abutment arm is provided, and the first unit is connected to the second unit such that the first unit is swingable relative to the second unit and the swing shaft of the abutment arm when the first unit is in an operational posture attached to an image recording apparatus.

2. The feed apparatus according to claim 1, further comprising a detecting unit configured to detect the abutment arm positioned at any one of the first position and the second position.

3. The feed apparatus according to claim 1, wherein the swing shaft of the abutment arm is arranged upstream of the rotational shaft of the feed roller in the feed direction.

4. The feed apparatus according to claim 1, wherein the end of the abutment arm protrudes downstream in the feed direction.

5. The feed apparatus according to claim 1, wherein the abutment arm includes a plurality of arms provided as a pair, and the arms are arranged to interpose the feed roller therebetween in a direction which is orthogonal to the feed direction and which extends along the support surface.

6. An image recording apparatus, comprising:

a feed apparatus as defined in claim 1, and a recording unit configured to record an image on a sheet fed by the feed roller.

7. A feed apparatus, comprising:

a support unit including a support surface which is configured to support a sheet;

a feed roller configured to feed the sheet supported by the support surface in a feed direction;

an insert portion provided on the support surface;

an abutment arm configured to swing between a first position at which an end of the abutment arm is positioned in the insert portion and a second position at which the end of the abutment arm is positioned outside of the insert portion, a position of a swing shaft of the abutment arm in the feed direction being fixed;

a separation piece which has an upper surface configured to separate the sheet fed in the feed direction from another sheet supported by the support surface; and a biasing member configured to bias the abutment arm toward the first position;

wherein the abutment arm is configured such that, in a case that the sheet is supplied onto the support surface, the abutment arm is positioned at the first position so that the sheet, which is moved in the feed direction to be placed on the support surface, is pushed by a portion of a surface of the abutment arm to the support surface prior to abutting the feed roller, the portion of the surface of the abutment arm being positioned outside of the insert portion and being positioned upstream of the feed roller in the feed direction, in a case that the abutment arm is positioned at the second position, the end of the abutment arm abuts an upper surface of the sheet supported by the support surface, a rotational shaft of the feed roller is positioned upstream of the upper surface of the separation piece in the feed direction, and the position of the swing shaft of the abutment arm is stationary in a direction orthogonal to the support surface and orthogonal to a central axis of the swing shaft when the abutment arm swings from the first position to the second position.

8. The feed apparatus according to claim 7, further comprising a detecting unit configured to detect the abutment arm positioned at any one of the first position and the second position.

9. The feed apparatus according to claim 7, wherein the swing shaft of the abutment arm is arranged upstream of the rotational shaft of the feed roller in the feed direction.

10. The feed apparatus according to claim 7, wherein the end of the abutment arm protrudes downstream in the feed direction.

11. The feed apparatus according to claim 7, wherein the abutment arm includes a plurality of arms provided as a pair, and the arms are arranged to interpose the feed roller therebetween in a direction orthogonal to the feed direction and extending along the support surface.

12. An image recording apparatus, comprising:

a feed apparatus as defined in claim 7, and a recording unit configured to record an image on a sheet fed by the feed roller.

13. A feed apparatus, comprising:

a support unit including a support surface which is configured to support a sheet, wherein the support surface is inclined relative to a vertical direction and a horizontal direction when in an operational posture;

a feed roller configured to feed the sheet supported by the support surface in a feed direction;

an insert portion provided on the support surface;

an abutment arm configured to swing between a first position at which an end of the abutment arm is positioned in the insert portion and a second position at which the end of the abutment arm is positioned outside of the insert portion, a position of a swing shaft of the abutment arm in the feed direction being fixed;

a separation piece which has an upper surface configured to separate the sheet fed in the feed direction from another sheet supported by the support surface; and a biasing member configured to bias the abutment arm toward the first position;

wherein the abutment arm is configured such that, in a case that the abutment arm is positioned at the first position, an end of the sheet, which is moved in the feed direction so that the sheet is placed on the support surface, is pushed by a portion of a surface of the abutment arm to the support surface prior to abutting the feed roller, the portion of the surface of the abutment arm being positioned outside of the insert portion and being positioned upstream of the feed roller in the feed direction, in a case that the abutment arm is positioned at the second position, the end of the abutment arm abuts an upper surface of the sheet supported by the support surface, a rotational shaft of the feed roller is positioned upstream of the upper surface of the separation piece in the feed direction, and the position of the swing shaft of the abutment arm is stationary in a direction orthogonal to the support surface and orthogonal to a central axis of the swing shaft when the abutment arm swings from the first position to the second position.

14. The feed apparatus according to claim 13, further comprising a detecting unit configured to detect the abutment arm positioned at any one of the first position and the second position.

15. The feed apparatus according to claim 13, wherein the swing shaft of the abutment arm is arranged upstream of the rotational shaft of the feed roller in the feed direction.

16. The feed apparatus according to claim 13, wherein the end of the abutment arm protrudes downstream in the feed direction.

17. The feed apparatus according to claim 13, wherein the abutment arm includes a plurality of arms provided as a pair, and the arms are arranged to interpose the feed roller therebetween in a direction orthogonal to the feed direction and extending along the support surface.

18. An image recording apparatus, comprising:

a feed apparatus as defined in claim 13, and a recording unit configured to record an image on a sheet fed by the feed roller.

* * * * *